US010632357B1

(12) United States Patent
Hudson

(10) Patent No.: US 10,632,357 B1
(45) Date of Patent: Apr. 28, 2020

(54) SWING TRAINING DEVICE

(71) Applicant: Polygon Athletix, LLC, Naples, FL (US)

(72) Inventor: Christopher L. Hudson, Orlando, FL (US)

(73) Assignee: POLYGON ATHLETIX, LLC, Naples, FL (US)

( * ) Notice: Subject to any disclaimer, the term of this patent is extended or adjusted under 35 U.S.C. 154(b) by 0 days.

(21) Appl. No.: 15/963,040

(22) Filed: Apr. 25, 2018

Related U.S. Application Data

(60) Provisional application No. 62/489,955, filed on Apr. 25, 2017.

(51) Int. Cl.
*A63B 69/36* (2006.01)
*A63B 102/32* (2015.01)

(52) U.S. Cl.
CPC ..... *A63B 69/3667* (2013.01); *A63B 2102/32* (2015.10); *A63B 2210/50* (2013.01); *A63B 2225/093* (2013.01)

(58) Field of Classification Search
CPC ..... A63B 69/3667
USPC ..... 473/257, 258
See application file for complete search history.

(56) References Cited

U.S. PATENT DOCUMENTS 4,928,975 A * 5/1990 Skelley ..... A63B 69/3676 473/264
5,429,367 A * 7/1995 Amos ..... A63B 69/3644 473/259
5,816,932 A * 10/1998 Alexander ..... A63B 69/3644 473/259
6,322,456 B1 * 11/2001 Benggon ..... A63B 69/0057 473/219
7,238,116 B1 * 7/2007 Sulzener ..... A63B 69/3641 473/258
8,282,509 B1 * 10/2012 Michaelson ..... A63B 69/36 273/400
8,696,480 B2 * 4/2014 Sasser ..... A63B 69/3641 473/208
9,283,463 B2 * 3/2016 Zimmerman, II . A63B 69/3644
9,561,421 B2 * 2/2017 Hungelmann ..... A63B 69/0057
10,022,609 B2 * 7/2018 Medley ..... A63B 69/0057
2007/0117642 A1 * 5/2007 Fiori ..... A63B 63/00 473/258

* cited by examiner

*Primary Examiner* — John E Simms, Jr.
*Assistant Examiner* — Rayshun K Peng
(74) *Attorney, Agent, or Firm* — Womble Bond Dickinson (US) LLP

(57) ABSTRACT

A swing training apparatus comprising a frame having one or more sections for guiding a swing of a user; a first support member coupled to a side of the frame and suspending the side of the frame above ground; and a second support member coupled to an opposite side of the frame and suspending the opposite side of the frame above ground, and wherein the first support member and the second support member together are operable to suspend the frame above the ground at a predetermined angle.

17 Claims, 18 Drawing Sheets

SWING TRAINING DEVICE

CROSS-REFERENCE TO RELATED APPLICATION

The application is a non-provisional application of U.S. Provisional Patent Application No. 62/489,955, filed Apr. 25, 2017 and incorporated herein by reference.

FIELD

A device and method for swing training is described. Other embodiments are also described herein.

BACKGROUND

There are numerous devices, new equipment and new approaches that have been developed over the past 50 years, in an effort to improve the handicaps of golfers. Statistics prove that of the approximately 25 million golfers in the United States, to this point, nothing on the market has helped reduce handicaps of the general golfing public.

A proper understanding of the geometrical, angular and anatomical movements a participant should emulate is important in any sport requiring a swinging or athletic motion, especially golf. Many golfers do not understand how these motions should be performed because they are unable to physically see and/or follow actual geometrical guides while practicing and therefore how to interact anatomically during the different segments of a swing. This inability to actually see and follow where and when these angular movements take place, results in a lack of control, power, missed shots, inferior performance and frustrations because the anatomical sequence is misunderstood.

Another problem experienced by many golfers is improper hip rotation. Many golfers, in an attempt to get maximum angular momentum, rotate their hips excessively, causing reverse pivot, which can result in slicing of the golf ball or an insufficient drive. Conversely, insufficient hip rotation limits the full potential of the swing and results in shorter drives of the golf ball. In addition, this type of behavior frequently promotes injuries to the lower back and other joints, due to the concussive nature of trying to force the body to do something it is not designed to do.

The human mind at times has difficulty visualizing and replicating a particular motion or movement, especially those motions that are comprised of multiple movements in sequence. While many golfers understand the general, circular path the club head needs to travel around the body, it has a difficult time understanding how the different portions of the body must move in coordination and sequence to create the proper path.

Therefore because of this difficulty, there is a need for an actual, three-dimensional apparatus to serve as a physical guide to teach golfers the proper stance, swing and sequential movements required to properly strike the ball and do so on a consistent basis.

Generally speaking, other products have tried to achieve comparable results but are unable to do so because the products are fundamentally and geometrically unsound in their approach. Some devices place restrictions on the movement of the club by locking the club into a circular motion on an incorrect plane, while others inhibit the natural progressive movements of the swing by forcing the user to drag their club along a circular object. Unfortunately, placing such restrictions on the club acts as a deterrent or disruption in allowing the body to move naturally and increases the likelihood of creating or exacerbating incorrect movements.

Still other products utilize restrictive or unsound biomechanical approaches to reduce certain parts of the body from moving naturally. If a person is not allowed to move freely during the golf swing it can create problems. The body or certain parts of the body are not meant to be restricted when performing an athletic motion and products whose sole purpose is to provide some sort of restriction are forcing bad habits on the golfer and will negatively impact his performance while on the golf course.

Even other products provide auditory mechanisms to notify a person when they move past a certain position or make an incorrect movement. Unfortunately, such auditory mechanisms do not teach the golfer the proper swing and create dependency on auditory noise, which is not available when a golfer is playing on a golf course.

SUMMARY

The present invention includes a swing, stance and movement training device, mechanism, or system and more particularly, a device to teach the proper geometric, angular, and anatomical movements required to properly swing a golf club, baseball bat, tennis racket or any other type of sports equipment requiring a swinging motion. In terms of golf, practice on this device will reduce a golfer's handicap. Representatively, for golf, the invention (device or apparatus) can be modified based on the style swing (modern or otherwise) the user wants to perfect. The user stands within the polygon and uses the geometrical bars and angles as guides for precise body and club movement. The device itself is easily assembled, collapsible and transportable.

By practicing a swinging motion with the swing training device and following the actual guide posts and angles created by the device, the muscle memory created by repetition on the device will allow the user to perform their swing properly and replicate the proper sequence of movements, for example, on the golf course resulting in lower scores.

Representatively, the swing training device can be used to teach the proper geometrical, angular, and anatomical movements in a nonrestrictive manner to guide the user into proper form and movement. For example, the swing training device may guide and program the mind to follow the natural geometry of the human body to achieve the perfect swing mechanics. In addition, the swing training device may guide and allow all golfers to understand the sequential movements that are necessary to make the proper athletic swing motion. By using the swing training device, the motor memory and insight gained by following this geometric blueprint that surrounds the body while within the device, will result in the same movement being achieved again and again by the golfer while on the golf course.

The swing training device avoids many of the common issues with current training devices and teaches the golfer the correct geometrical, angular and anatomical movements, by providing a three-dimensional space, with physical guide posts, for the golfer to learn and practice within. Through repetition of the proper movement and swing techniques, muscle memory will allow a golfer to repetitively and consistently replicate the correct geometrical, angular, and anatomical movements while performing on the golf course.

Representatively, in one embodiment, the swing training device may teach the correct geometrical, angular, and anatomical movements which must take place when swinging a golf club or other athletic swinging or throwing motion. Since the swing training device is a three-dimensional device, it shows the actual geometric guide lines that surround the body and the angles that one should follow to create the perfect swing. This, in turn, provides the visible blueprint necessary to achieve the perfect swinging or athletic motion.

In addition, the swing training device may be used to teach the proper geometric planes on which the golf club needs to be swung. This is also accomplished by the actual three-dimensional nature of the device.

Still further, the swing training device may teach and make known when the correct angular changes and movements of the body, arms, hands and club must take place, as it relates to the proper planes of the swing at certain points in time. This is also accomplished by the actual three-dimensional nature of the device.

The swing training device may also teach the proper inline shifting motion of the knees, hips and shoulders (the body) without leaning to the right or left (staying centered) when singing the golf club. This center balanced weight shift promotes coil instead of load.

In addition, the swing training device may teach the golfer how to achieve proper posture in a nonrestrictive manner, as well as a swing that protects the body and all its parts by swinging in accordance with the geometrical laws of nature as it relates to the human body. The device may further enable one to practice repeatedly the proper and geometrically optimized swing movements to instill the correct motor memory to train the mind to get the body to move properly while on the golf course.

The present invention fulfills the above and other objects because, for example, as a three-dimensional apparatus the user stands within, the invention acts as a visible guide to teach the proper technique, form, angle and sequence of all the proper segments of the swing.

Various benefits of the invention include, but are not limited to, achieving perfect posture, maintain proper spine angle throughout the swing, increased power, increased accuracy, staying centered throughout the swing, shift the body correctly the way it was designed, prevent coming over the top, achieve the correct inside attack angle during the downswing, truly understand swing planes, finally see and understand angular movement and when these changes must take place at specific points in time and why, stop casting the club, stop flipping through impact, learn the proper release, learn how to use the body for leverage, swing on plane, swing in balance, learn proper putting techniques, learn the proper short game movements the body is really capable of, and have a repeatable swing.

Representatively, in one embodiment, the invention is directed to a swing training apparatus including a frame having one or more sections for guiding a swing of a user, a first support member coupled to a side of the frame, and a second support member coupled to an opposite side of the frame, and the first support member and the second support member together are operable to suspend the frame above ground at a predetermined angle. In some embodiments, the one or more sections form a polygon shaped frame. In addition, the predetermined angle of the frame may be within a range of from 30 degrees to 60 degrees relative to ground. In some embodiments, the first support member may be connected to a front side of the frame and the second support member may be connected to a back side of the frame. In addition, the frame may be symmetrical about a center axis running from a front side to a back side of the frame, and the first support member may be connected a section positioned along one side of the center axis and the second support member may be connected to a section positioned along another side of the center axis. In some embodiments, the first support member and the second support member may be connected to the frame at rotating connection joints, and the rotating connection joints may allow for adjustment of the predetermined angle of the frame. In addition, the first support member and the second support member may be connected by a laterally extending bar, the laterally extending bar having an adjustable length. Still further, the one or more sections of the frame may be connected to one another by joints that allow for movement of one frame section with respect to another frame section. In some embodiments, the device further includes a posture pole that extends above the frame at a predetermined angle suitable for aligning a posture of a user. Still further, the device may include a putting attachment that is removably attached to one of the first support member or the second support member and provides a guide for a putting motion. In some cases, the frame, the first support member and the second support member are collapsible to a storage configuration.

In another embodiment, the invention includes a swing training device having a frame with one or more sections that are joined together to define an open space within the frame; a first support member coupled to a side of the frame and suspending the first side of the frame above ground; and a second support member coupled to an opposite side of the frame and suspending the opposite side of the frame above ground, and wherein the first support member and the second support member together are operable to adjust an angle of the frame relative to ground. In some cases, the one or more sections comprise from six sections to eight sections that are connected together by joints to form a polygon shaped open space dimensioned to surround a user during a training operation. In addition, the one or more sections may include at least a first section and a second section that form an angle with respect to one another, and the first section, the second section and the angle are selected to guide a swing of a user. In some cases, the angle of the frame relative to ground is adjustable within a range of from 30 degrees to 60 degrees. The first support member and the second support member may include at least one adjustable joint operable to adjust the angle of the frame relative to ground in 5 degree increments. In some embodiments, the one or more sections form a hexagon shaped frame and the angle of the frame relative to ground is from 30 degrees to 60 degrees. In other cases, the sections form an octagon shaped frame and the angle of the frame relative to ground is 60 degrees or less. The device may further include a posture pole extending above the frame at an angle suitable for guiding a posture of a user positioned within the open space. In addition, in some embodiments, the one or more sections are connected together by collapsing joints that allow the frame to fold into a storage configuration. The first support member or the second support member may further include a vertical member and a horizontal member connected by a collapsing joint that allows for the vertical member and the horizontal member to fold into a storage configuration.

The above summary does not include an exhaustive list of all aspects of the present invention. It is contemplated that the invention includes all apparatuses that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments disclosed herein are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

Figure 1:
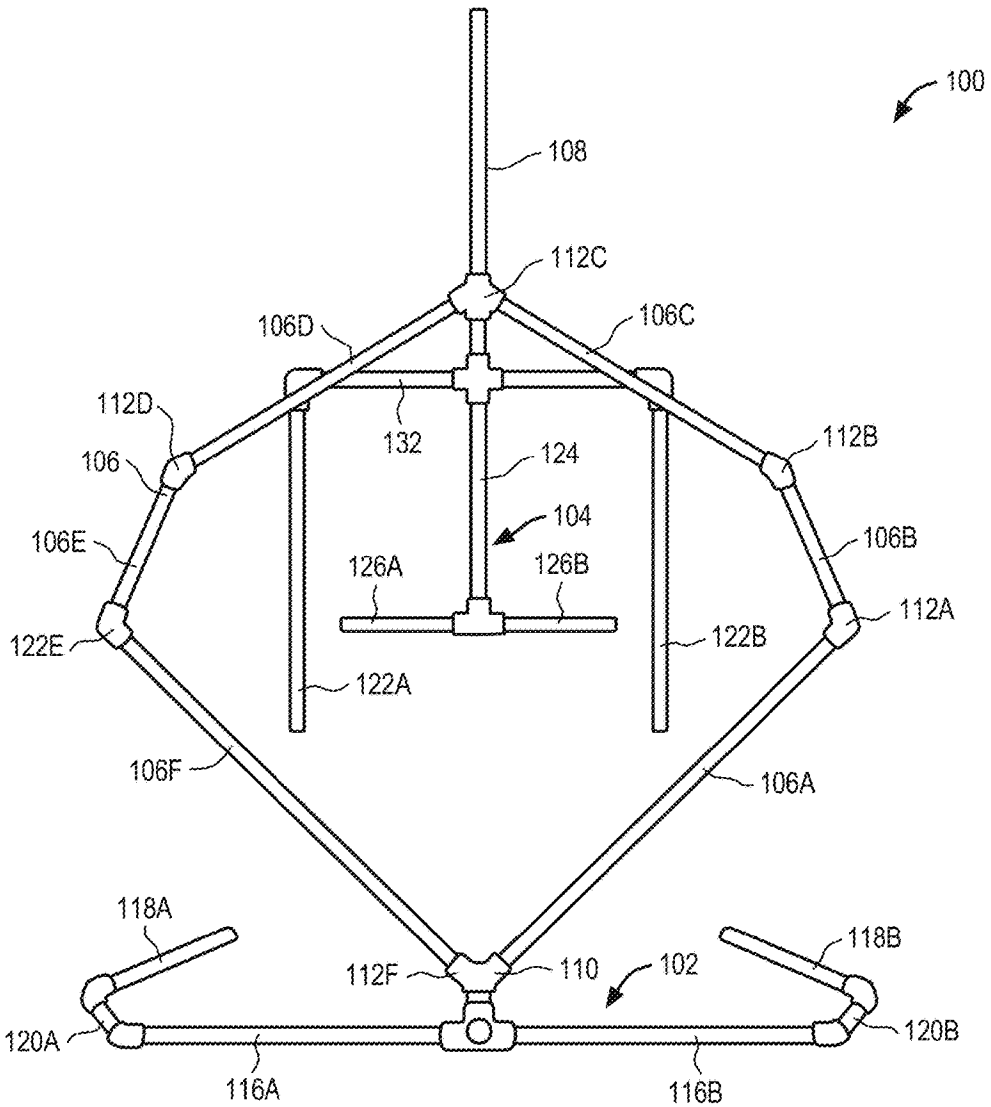
FIG. 1 illustrates a front perspective view of one embodiment of a swing training device.

In this section we shall explain several preferred embodiments with reference to the appended drawings. Whenever the shapes, relative positions and other aspects of the parts described in the embodiments are not clearly defined, the scope of the embodiments is not limited only to the parts shown, which are meant merely for the purpose of illustration. Also, while numerous details are set forth, it is understood that some embodiments may be practiced without these details. In other instances, well-known structures and techniques have not been shown in detail so as not to obscure the understanding of this description.

The terminology used herein is for the purpose of describing particular embodiments only and is not intended to be limiting of the invention. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

FIGS. 1-4, FIGS. 6A-6C and FIGS. 7A-7C illustrate various embodiment of a swing training device. The swing training device of FIGS. 1-2 and FIGS. 7A-7C illustrate swing training devices having a frame that is positioned at an angle of approximately 30 degrees with respect to ground, and therefore these embodiments may be referred to herein as 30 degree swing training devices, or 30 degree plane cubic swing training devices. FIGS. 3-4 and FIGS. 6A-6C illustrate further embodiments of swing training devices including a frame that is positioned at an angle of approximately 60 degrees with respect to ground, and may therefore be referred to herein as 60 degree swing training devices, or 60 degree plane modern swing trainers. In some embodiments, the swing training devices may be formed by a number of pieces or sections that are separable pieces which, when assembled, form the frame of the swing trainer. In other embodiments, the pieces or sections of the swing training devices are part of a single, integrally formed structure. In addition, it should be understood that during swing training, the user stands within the open center of the frame such that the frame sections surround the user, and each of the pieces or sections making up the frame are at a particular angle with respect to one another selected to guide the user's swing. Thus, the frame pieces or sections, in combination with the angle of the frame, provides a three-dimensional training system. Representatively, the frame sections created a frame geometry that provides a path that the club head should follow during a swing. For example, the 60 degree swing training device of FIGS. 3-4 and FIGS. 6A-6C is intended to correspond to the way the modern swing is taught in the back swing. The angle changes between the different frame sections, in combination with the angle of the frame, provides a three-dimensional guide for the user, that is not otherwise available in conventional training approaches. In addition, the downswing in the modern swing may shallow out therefore, in some embodiments, the 60 degree angle of the frame can also be adjusted to 30 degrees to accommodate the flattening or shallowing out of the downswing. Similarly, the 30 degree swing training device of FIGS. 1-2 and FIGS. 7A-7C provides a guide for movement of the body during a swing as the body shifts to the right and then to the left. The body should remain parallel and perpendicular to the frame geometry at all times. Similar to the 60 degree swing training device, the frame of the 30 degree swing training device may have an adjustable angle.

Representatively, in some embodiments, the angle of the frame in any of the swing training devices of FIGS. 1-4, FIGS. 6A-6C and FIGS. 7A-7C may be adjusted within a range of from 30 to 60 degrees, for example, the frame angle may be adjusted in 5 degree increments to approximately 30, 35, 40, 45, 50, 55 and 60 degrees, with respect to ground. These adjustments are so the end user can choose the degrees and angles they would like to work on. The preferred angles for each frame may be 30, 45 and 60 degrees.

Figure 2:
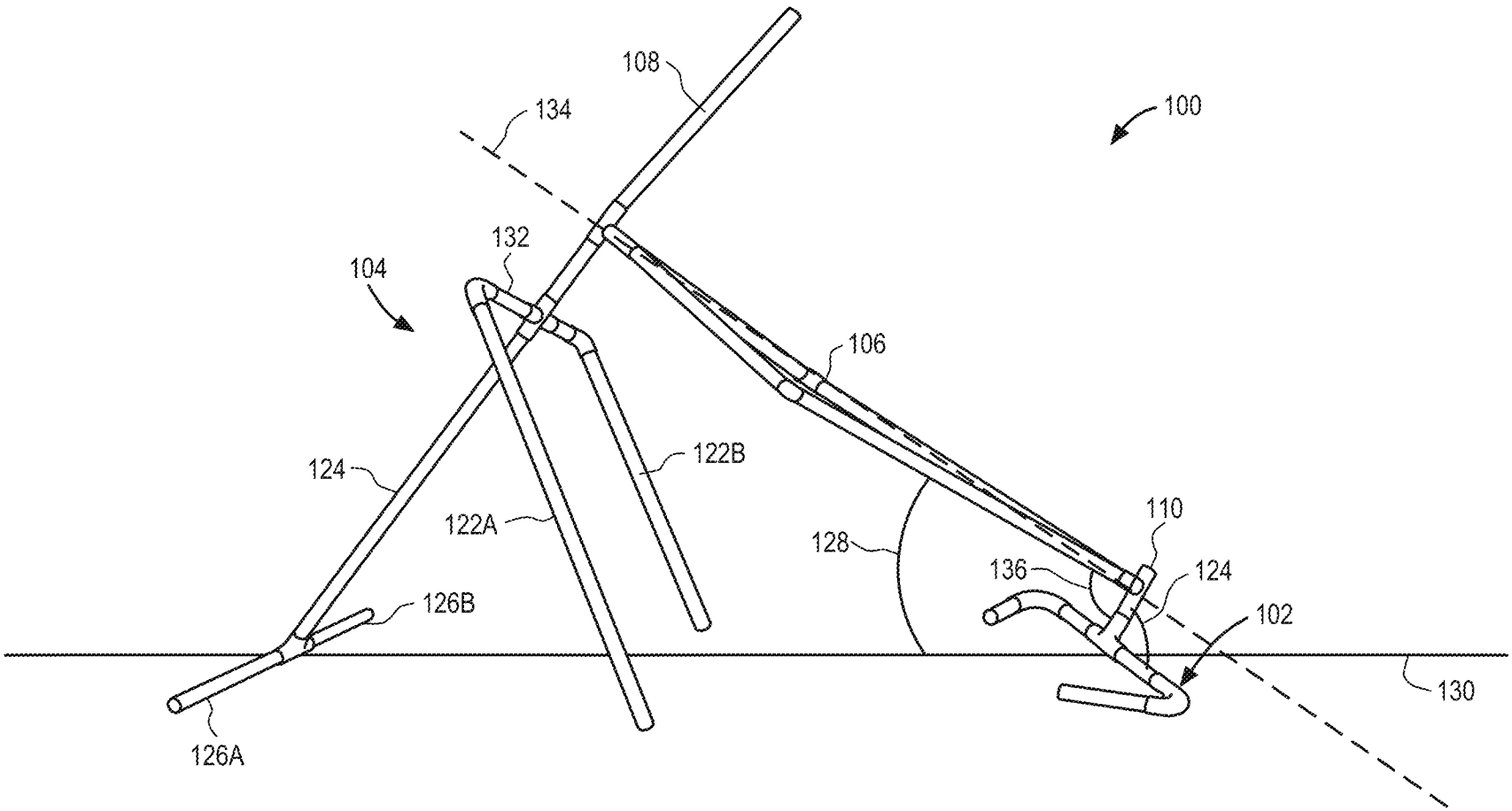
FIG. 2 illustrates a side perspective view of the training device of FIG. 1.

Referring now in more detail to FIGS. 1-2, swing training device 100 may include a frame 106 that is supported at an angle with respect to ground by a first support member 102 and a second support member 104. In addition, swing training device 100 may include a posture pole 108 that connects to frame 106 and second support member 104, and may also serve as a posture guide. In addition, posture pole 108 may be considered connected to first support member 102 via frame 106 (e.g., a front tip vertical support 110).

Referring now in more detail to frame 106, in some embodiments, frame 106 may have the shape of a polygon and therefore also be referred to herein as a polygon frame. For example, frame 106 may be made of a number of pieces, sections, or links, which when assembled form a polygon, for example, a square, rectangle, pentagon, hexagon, or any other closed plane figure having three or more sides. In addition, it is contemplated that although a polygon shape is shown and described, the frame 106 may, in other embodiments have another shape, for example a circle, ellipse, racetrack or the like. In the embodiment illustrated in FIGS. 1-2, frame 106 may have six frame sections, for example, sections 106A, 106B, 106C, 106D, 106E, and 106F, which together form an open space within the frame that is defined by sections 106A-106D and in the shape of a six sided polygon. Frame 106 in this configuration may therefore also be referred to as a hexagon shaped frame. Each of frame sections 106A-106F may be connected at one of joints 112A, 112B, 112C, 112D, 112E and 112F, as shown. Sections 106A-106C may form the left side of the frame and sections 106D-106F may form the right side of the frame (as viewed by the user). Frame sections 106A-106F may, in some embodiments, be any type of rigid member capable of forming the desired frame shape. For example, frame sections 106A-106F may be poles, pipes, beams, or the like, made of a plastic, metal or any other sufficiently rigid material. Still further, one or more of frame sections 106A-106F may have a fixed length in some embodiments, while in others, one or more of frame sections 106A-106F may have a modifiable length so that a size and/or shape of frame 106 can be adjusted. For example, frame sections 106A-106F may have a telescoping or other configuration which allows for the length to be adjusted. In addition, joints 112A-112F may, in some embodiments, be formed by pieces separate from sections 106A-106F, or may be formed by the interfacing ends of sections 106A-106F. In addition, in some embodiments, one or more of joints 112A-112F may be an articulated or flexible joint in that they allow one section to move with respect to another section, for example, to change the shape of frame 106 when desired.

As previously discussed, the combination of the sections 106A-106F, and angles created at the joints 112A-112F, result in a frame 106 having a particular geometry that provides a visual path for the club head to following during swing training. Thus, to achieve the desired geometry, the various sections 106A-106F and angles between the sections, are specially selected to achieve a geometry suitable for the desired swing training. For example, in the embodiment of FIGS. 1-2, where the frame 106 is at a 30 degree angle relative to ground, the angle at joints 112C and 112F may be approximately 90 degrees (e.g., the angles between sections 106C and 106D, and sections 106A and 106F), while the angles at the remaining joints 112A, 112B, 112E, 112D may be different (e.g., greater or less than 90 degrees). In addition, it can be seen from FIGS. 1-2 that the length of one or more of sections 106A-106D may be different to achieve the desired geometric shape. For example, the length of sections 106A, 106C, 106D and 106F, which are closest to the back side and/or front side of the user, may be greater than the length of sections 106B and 106E, which are closes to the sides of the user. For example, in one embodiments, one or more of sections 106A, 106C, 106D and 106F may be at least twice as long as one or more of sections 106B and 106E. It should be noted, however, that regardless of the angles and/or lengths of the various sections, the frame 106 should be symmetrical between the right and left sides so that the resulting geometry of the frame 106 provides a swing pathway suitable for use by either a right or left handled user.

Referring now in more detail to first support member 102 and second support member 104, as can be seen from FIGS. 1-2, first and second support members 102 and 104, respectively, support frame 106 at the desired angle (e.g., from 30 degrees to 60 degrees) with respect to ground. For example, first support member 102 may be connected to, and support, a front side of frame 106 (e.g. a side of frame in front of the user during operation). First support member 102 may include a front vertical support 110. The front vertical support 110 can include a vertical support pipe connected to the frame 106 at the joint 112F. The vertical support 110 is dimensioned to extend and support the front side of frame 106 above ground, and is therefore considered a "vertical" support. It should be understood, however, that vertical support 110 is not necessarily at an angle of 90 degrees with respect to ground. Rather, vertical support 110 can extend in any direction away from ground, and therefore be at any angle or orientation other than parallel to ground. For example, as can be more clearly seen from FIG. 2, vertical support 110 may be angled forward 60 degrees relative to ground 130 (see angle 124), and at an angle of approximately 90 degrees relative to frame 106 (see angle 136) to accommodate the 30 degree pitch or angle 128 of frame 106. In addition, as illustrated by FIG. 2, the pitch or angle of frame 106 corresponds to the pitch or angle of the frame plane 134 with respect to the surface of ground 130.

First support member 102 may further include a horizontal support base including support members 116A and 116B that extend laterally from vertical support 110 and along the ground 130, to prevent tilting of the swing trainer 100. The horizontal support base may further include a right foot guide 118A and left foot guide 118B, for additional stability. The foot guides 118A, 118B can connect to support members 116A and 116B, respectively, at joints 120A and 120B. Foot guides 118A, 118B may also extend along ground 130, similar to members 116A, 116B, but at an angle with respect to members 116A, 116B for added stability. For example, foot guides 118A, 118B may extend in a direction under frame 106, at an angle of approximately 45 degrees to 90 degrees, with respect to support members 116A, 116B respectively, to increase stability. Referring now in more detail to second support member 104, second support member 104 may be connected to, and support, a back side of frame 106 (e.g., a side of frame behind the user during operation). For example, second support member 104 may be connected to frame 106 at joint 112C. Second support member 104 may be considered to have an overall height or length (or z-height off the ground) greater than that of first support member 102 such that the back side of frame 106 is higher than the front side, and in turn, frame 106 can be supported at the desired angle (e.g., 30 degree or 60 degrees)

as previously discussed. Second support 104 can include a rear vertical support beam 124 that connects to the frame 106 and extends to the ground 130. In addition, second support member 104 may include support legs 122A and 122B that are connected together, and to the rear vertical support beam 124, by lateral support 132. Representatively, support legs 122A, 122B are connected to opposite ends of lateral support 132, and lateral support 132 is connected at its center to support beam 124. Support legs 122A, 122B, in turn, extend down to the ground 130 at an angle to support beam 124, providing additional stiffness and stability to training device 100. It should be understood that the size, length and/or angle of the vertical support beam 124 and/or support legs 122A, 122B, with respect to ground and/or each other, may be selected and/or adjusted to achieve the desired frame angle. The vertical support beam 124 can further include base members 126A and 126B that extend laterally along the ground to provide stability and prevent tilting.

In addition, in some embodiments, swing training device 100 may further include an posture pole 108, as previously discussed. Posture pole 108 may extend from an end of vertical support beam 124, and above frame 106, at a particular angle selected to guide a posture of the user. Representatively, in some embodiments, posture pole 108 may extend from beam 124 such that it is at an angle of approximately 60 degrees with respect to ground 130. In this aspect, when the user is positioned within frame 106 during training, the posture pole 108 is aligned with the user's back and provides the user with a visual cue for proper back alignment during the swing. In addition, it should be noted that the various connections and/or angles between the different pieces or sections of device 100 may be achieved using fixed joints and/or attachment members such as 3 and 4-way splitters, or articulated joints and/or attachment members so that the angles between the pieces can be modified as desired.

Figure 3:
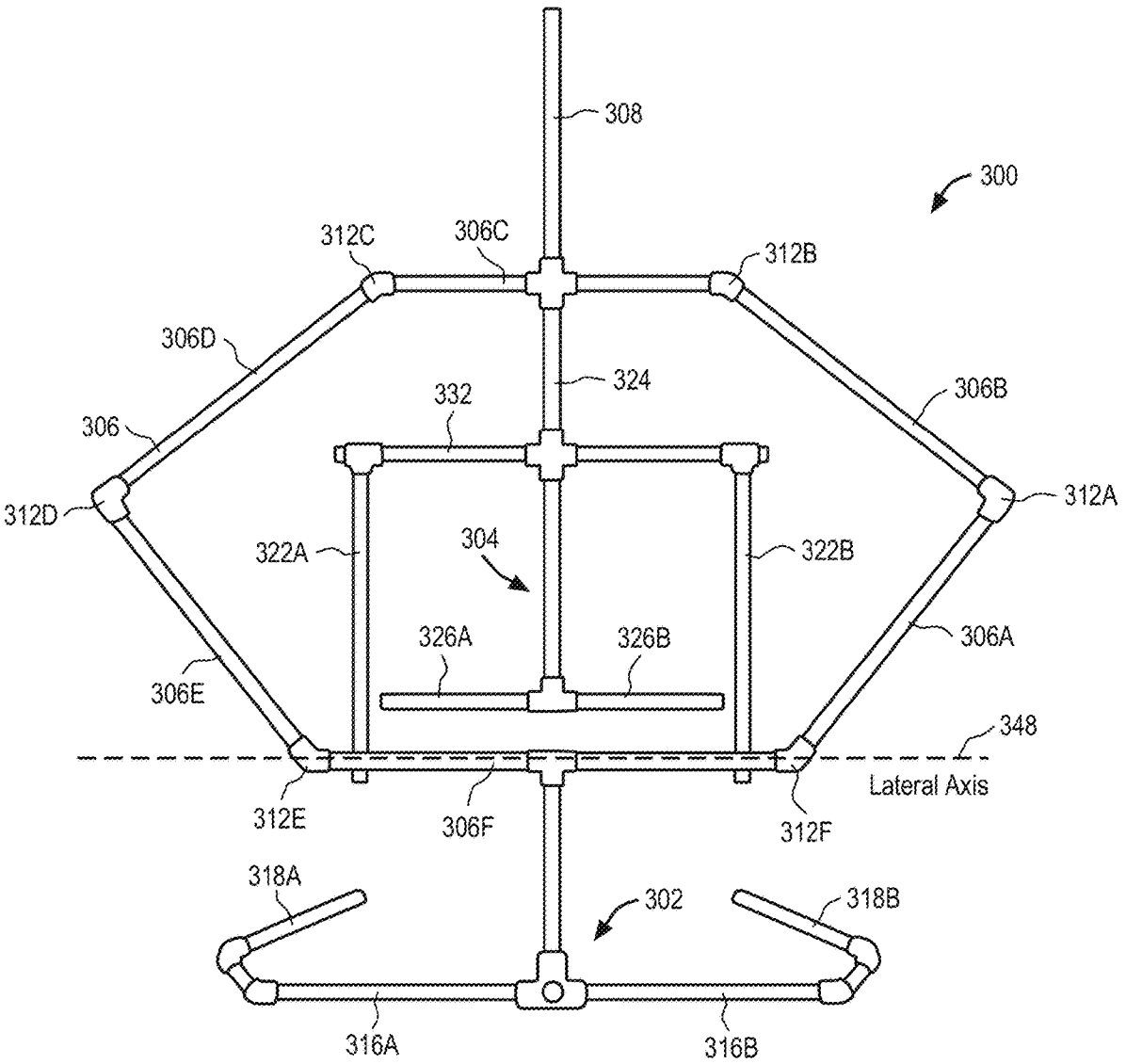
FIG. 3 illustrates a front perspective view of another embodiment of a swing training device.
Figure 4:
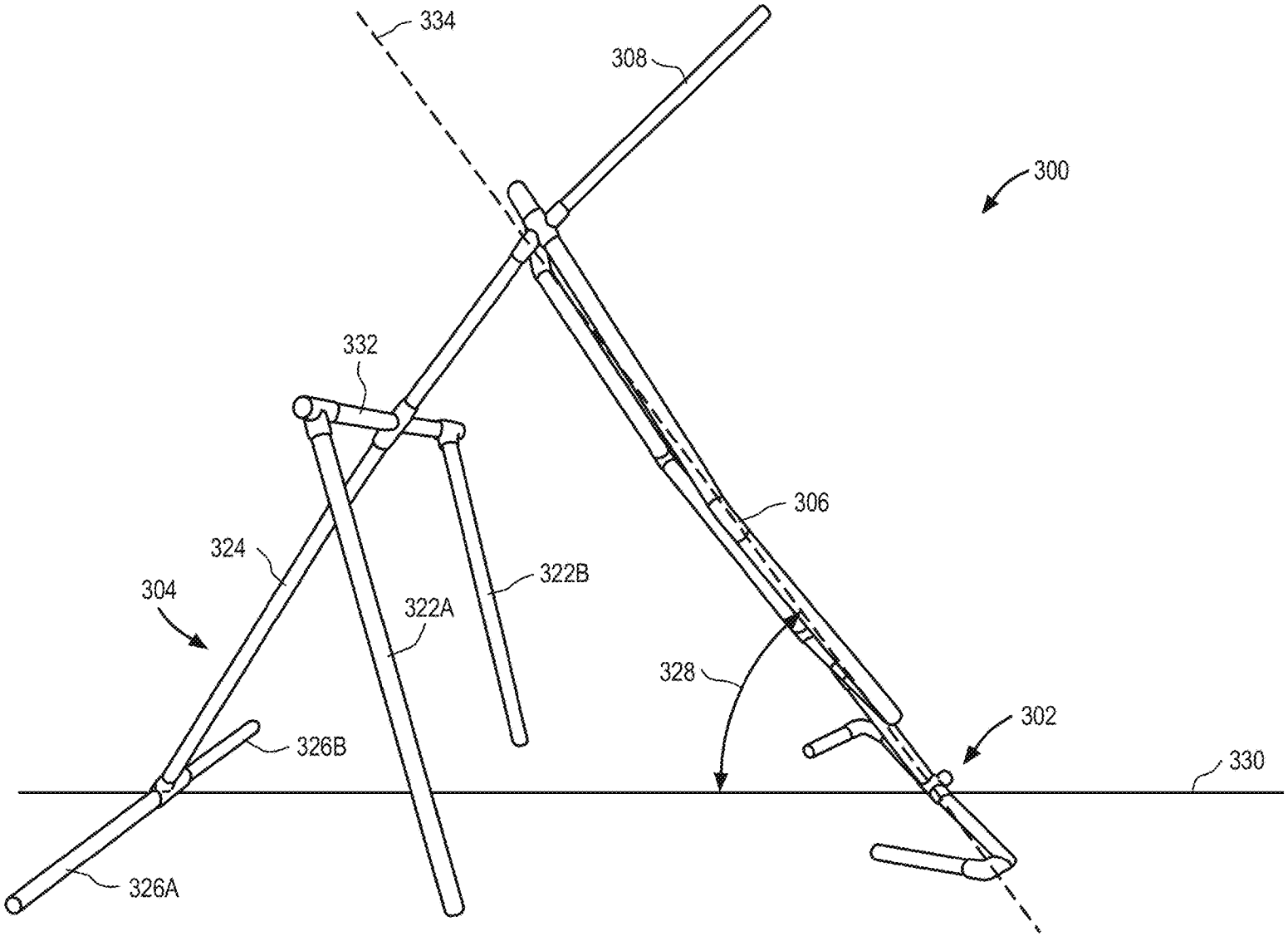
FIG. 4 illustrates a side perspective view of the training device of FIG. 3.

Referring now to FIGS. 3-4, FIGS. 3-4 illustrate another embodiment of a swing training device 300. Similar to swing training device 100, swing training device 300 may include a frame 302 that is positioned at an angle 328 with respect to ground 330 (see FIG. 2). In this embodiment, however, angle 328 is approximately 60 degrees. Swing training device 300 may therefore be used to train a different type of swing than training device 100, for example, a modern swing. In addition, it can be seen that the frame 306, while still a polygon, has a different shape than frame 106 of FIGS. 1-2. Representatively, frame 306 may include sections 306A, 306B, 306C, 306D, 306E, and 306F that are joined together by joints 312A, 312B, 312C, 312D, 312E, 312F, as shown, to form a hexagon that is wider than the hexagon shown in FIGS. 1-2. Representatively, in this embodiment, each of sections 306A-306F may have a similar overall length (although it is noted that some sections can be formed by multiple pieces). Sections 306A and 306B can form the left side of the hexagon and sections 306E, 306F can form the right side of the hexagon. Frame section 306C can form a top line and frame section 306F can form a bottom line, where the top line and bottom line are parallel to a lateral axis 348 (an axis from side to side, as shown in FIG. 3). In addition, the angles between the sections on the left and right sides, namely sections 306A and 306B and sections 306E and 306D, may be the same, and may be larger than the angles between the sections forming the front and back sides of frame 306 (e.g., sections 306F and 306C) to achieve an overall wider shape. For example, the angles between sections 306A and 306B (e.g., joint 312A), and sections 306E and 306D (e.g., joint 312D) may be approximately 90 degrees, while the angles formed by the remaining sections 306C and 306F (e.g., joints 312B, 312C, 312E, 312F) may be larger. This, in turn, creates a wider frame shape (as measured along the lateral axis). The overall shape of frame 306, however, may still be symmetrical such that frame 306 forms pathways for swing training of both right and left handed users.

In addition, similar to the swing training device of FIG. 1-2, swing training device 300 may include a first support member 302 and second support member 304 that support frame 306 at the desired angle (e.g., 60 degrees) with respect to ground. For example, first support member 302 may be connected to, and support, a front side of frame 306 (e.g. a side of frame in front of the user during operation). First support member 302 may include a front vertical support 310. The front vertical support 310 can include a vertical support pipe connected to the frame 306 at a center of section 306F. The vertical support 310 is dimensioned to extend and support the front side of frame 306 above ground, and is therefore considered a "vertical" support. It should be understood, however, that vertical support 310 is not necessarily at an angle of 90 degrees with respect to ground. Rather, vertical support 310 can extend in any direction away from ground, and therefore be at any angle or orientation other than parallel to ground. For example, as can be more clearly seen from FIG. 4, vertical support 310 may be angled backward 60 degrees relative to ground 330, and at an angle of approximately 180 degrees relative to frame 306 to accommodate the 60 degree pitch or angle 328 of frame 306. In addition, as illustrated by FIG. 4, the pitch or angle of frame 306 corresponds to the pitch or angle of the frame plane 334 with respect to the surface of ground 330.

First support member 302 may further include a horizontal support base including support members 316A and 316B that extend laterally from vertical support 310 and along the ground 330, to prevent tilting of the swing trainer 300. The horizontal support base may further include a right foot guide 318A and left foot guide 318B, for additional stability. The foot guides 318A, 318B can connect to support members 316A and 316B, respectively, at joints 320A and 320B. Foot guides 318A, 318B may also extend along ground 330, similar to members 316A, 316B, but at an angle with respect to members 316A, 316B for added stability. For example, foot guides 318A, 318B may extend in a direction under frame 306, at an angle of approximately 45 degrees to 90 degrees, with respect to support members 116A, 116B respectively, to increase stability. Referring now in more detail to second support member 104, second support member 104 may be connected to, and support, a back side of frame 106 (e.g., a side of frame behind the user during operation). For example, second support member 304 may be connected to frame 306 at joint 312C. Second support member 304 may be considered to have an overall height or length (or z-height off the ground) greater than that of first support member 302 such that the back side of frame 306 is higher than the front side, and in turn, frame 306 can be supported at the desired angle (e.g., 60 degrees) as previously discussed. Second support 304 can include a rear vertical support beam 324 that connects to the frame 306 and extends to the ground 330. In addition, second support member 304 may include support legs 322A and 322B that are connected together, and to the rear vertical support beam 324, by lateral support 332. Representatively, support legs 322A, 322B are connected to opposite ends of lateral support 332, and lateral support 332 is connected at its center to support beam 324. Support legs 322A, 322B, in turn, extend down to the ground 330 at an angle to support beam 324, providing additional stiffness and stability to training device 300. It should be understood that the size, length and/or angle of the vertical support beam 324 and/or support legs 322A, 322B, with respect to ground and/or each other, may be selected and/or adjusted to achieve the desired frame angle. The vertical support beam 324 can further include base members 326A and 326B that extend laterally along the ground to provide stability and prevent tilting.

In addition, in some embodiments, swing training device 300 may further include a posture pole 308. Posture pole 308 may be substantially the same as posture pole 108 discussed in reference to FIGS. 1-2.

It should further be understood that the swing trainer can comprise various poles, pipes, beams, or the like, made of a plastic, metal or any other sufficiently rigid material, connected together using, for example, various 3-way and 4-way splitters of various angles, as shown in FIGS. 1-4. In some embodiments, there may be any number of sides/sections to the polygon frame, for example, from about 4 sides to about 10 sides, for example, from 6 sides to 8 sides. In some embodiments, the various pieces (or plane poles) can form a cube or polygonal shaped opening (e.g., a square, rectangle, pentagon, hexagon, or the like), however, other shapes are also contemplated. FIGS. 1-4 further show various exemplary joint angles and dimensions for the various pieces; however, other angles and dimensions are also contemplated.

Figure 5:
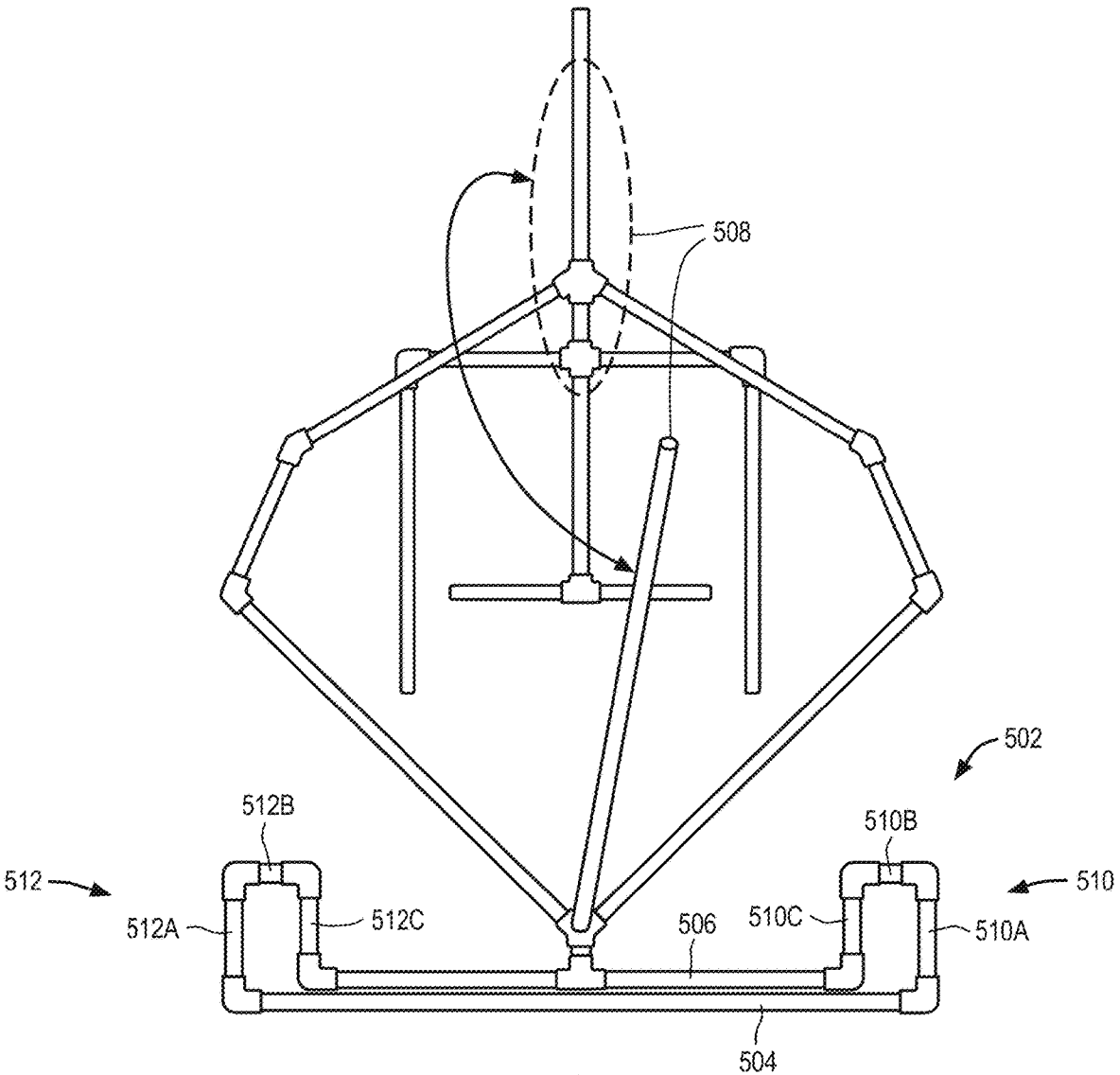
FIG. 5 illustrates a front perspective view of one embodiment of a putting attachment for a swing training device.

Referring now to FIG. 5, an optional putting attachment 502 may be attached to any of the swing training devices disclosed herein. This can be done, for example, by removing the feet guides and joints of the first support member (e.g., first support members 102 and 302 as shown in FIGS. 1-4) and coupling the putting attachment 502 to the remaining lateral support members of the first support member (e.g., support members 116A-116B, 316A-316B).

Representatively, putting attachment 502 may have a front rail 504 and a rear rail 506, that form a rectangular pathway configured to guide a user's golf club head through a straight putting motion. Advantageously, the rear rail 506 can be, or otherwise share portions of the first support member (e.g., members 116A-116B, 316A-316B, etc.), thereby using structural members as a putting guide. In addition, putting attachment 502 may include end members 510, 512 which connect the front rail 504 and rear rail 506 together in a parallel arrangement as shown. For example, end member 510 may include vertical guides 510A and 510C, which connect to, and extend vertically from, front rail 504 and rear rail 506, respectively. In addition, end member 510 may include a horizontal guide 510B which extends horizontally between guides 510A, 510C to connect the guides, and in turn rails 504, 506, together. Similarly, end member 512 may include vertical guides 512A and 512C, which connect to, and extend vertically from, front rail 504 and rear rail 506, respectively, and a horizontal guide 512B to connect the guides, and in turn rails 504, 506, together. The space created between the rails 504, 506 and end members 510, 512 provides a guide for learning a proper putting swing. In addition, in some embodiments, the swing training device may further include a front posture pole 508, the front posture pole 508 may be used instead of, or in addition to, the rear posture pole previously discussed (e.g., posture pole 108). The front posture pole 508 may, in some embodiments, be connected to the end of the vertical member of the first support member (e.g., member 110 of support member 102 of FIG. 1), such that it extends from a front side of frame, and is therefore in front of the user, during use. The front posture pole 508 may be used to help guide the user's posture by attaching a rope, band, string or the like, around the pole 508, and holding each end of the rope, band or string to achieve the desired posture, as will be discussed in more detail in reference to FIG. 12.

Figure 6A:
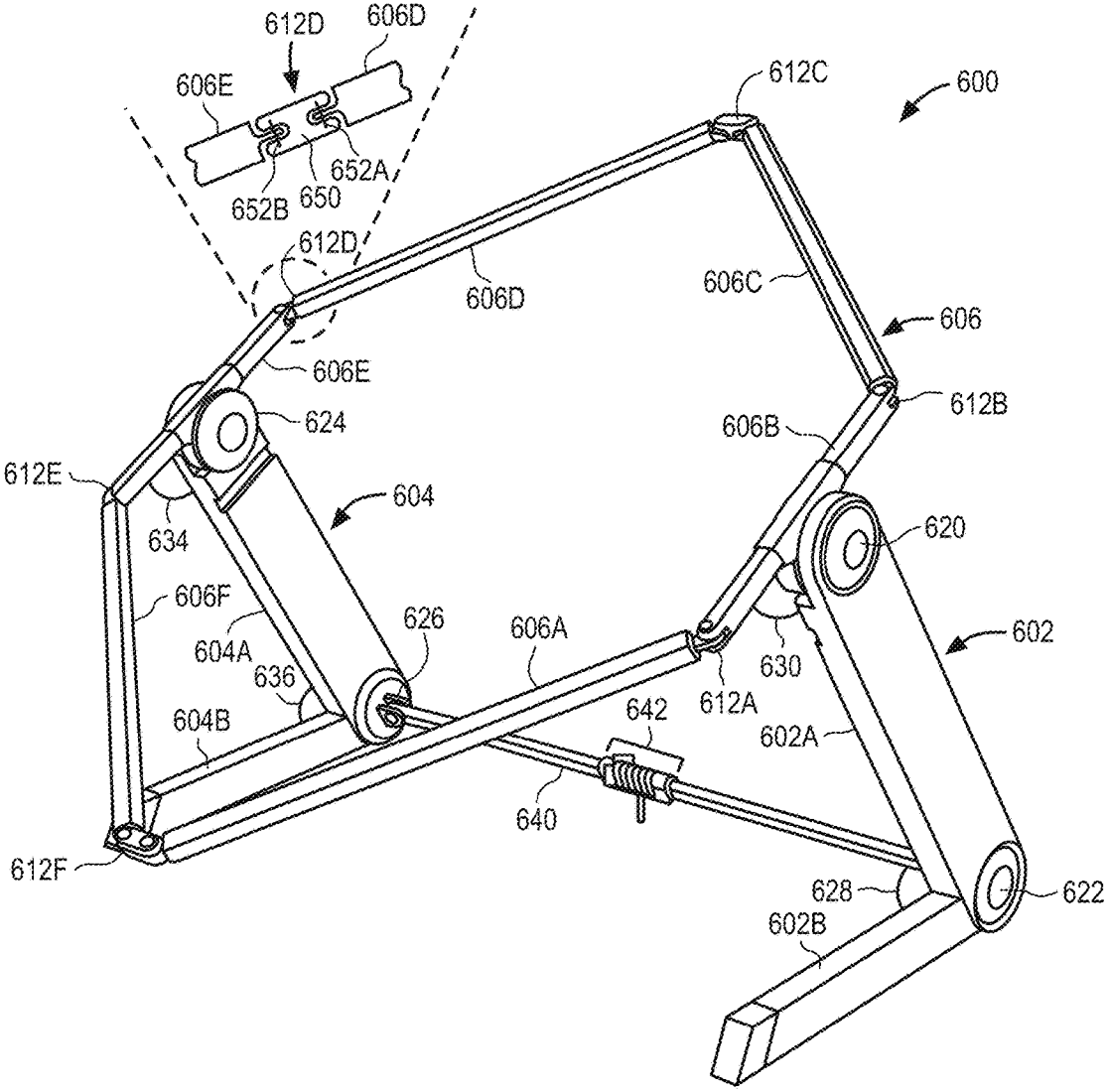
FIGS. 6A-6C illustrate front, back and back side perspective views of a training device.
Figure 6B:
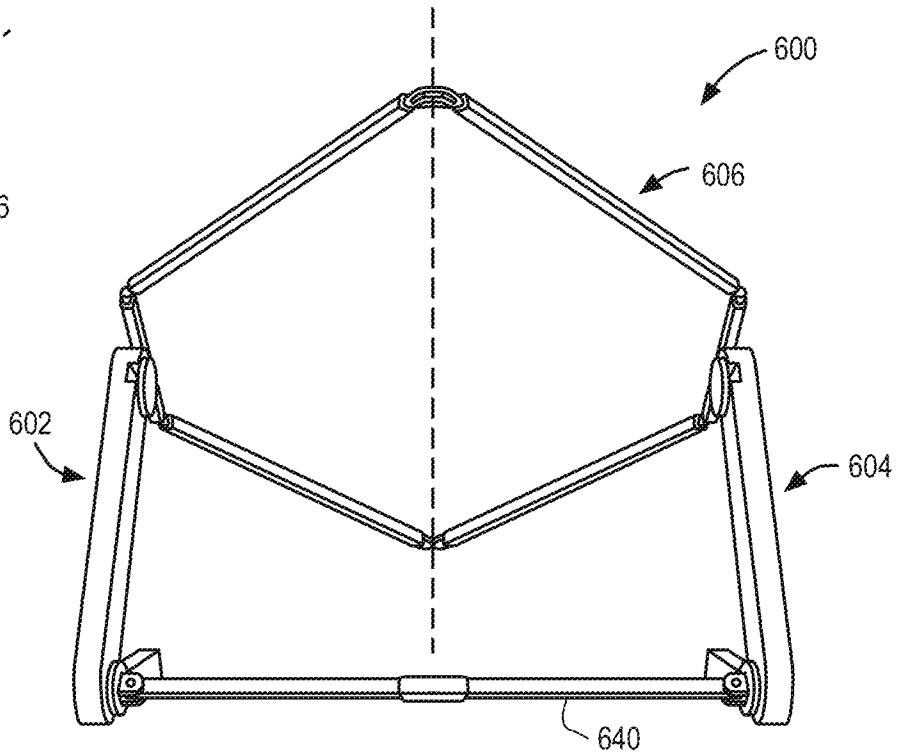
Figure 6C:
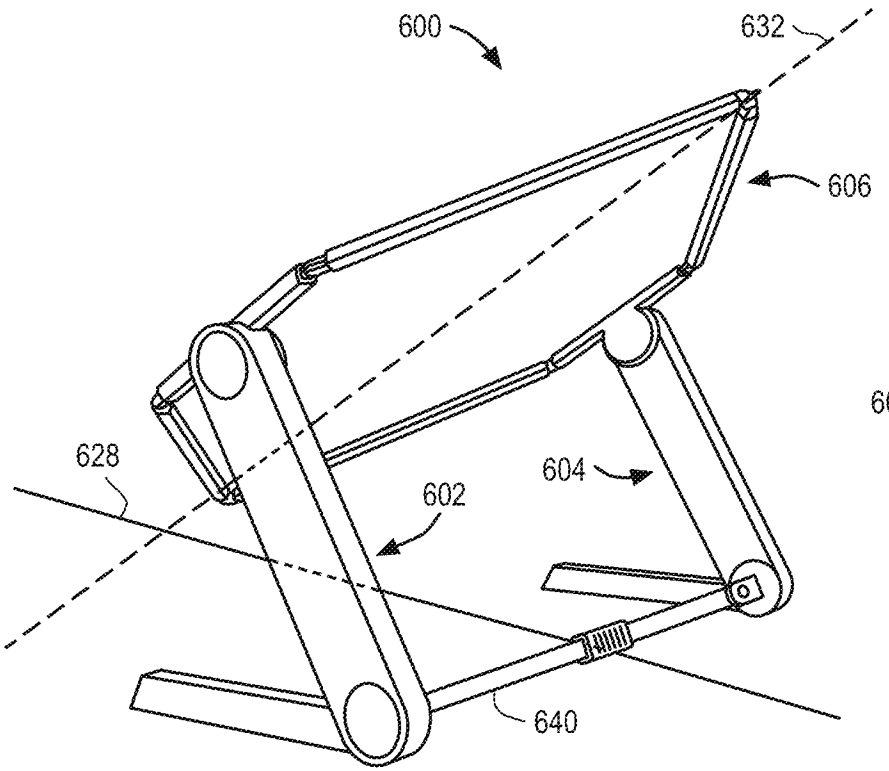

FIGS. 6A-6C illustrate perspective views of another embodiment of a swing training device. Swing training device 600 may be similar to swing training devices 100 and 300, previously discussed in reference to FIGS. 1-4, and include a frame 606 that is supported by first and second support members 602 and 604, respectively, at a desired angle. For example, FIGS. 6A-6C show a frame 606 of device 600 supported at an angle of approximately 60 degrees, as measured between the plane 632 of frame 606 and ground 630 (see angle 628 of FIG. 6C). Frame 606 may, however, be adjustable within a range of 30 degrees to 60 degrees. In addition, frame 606 may be similar to frame 106 of FIGS. 1-2 and include six sections 606A, 606B, 606C, 606D, 606E and 606F connected by joints 612A, 612B, 612C, 612D, 612E and 612F. Sections 606A-606F may be connected by joints 612A-612F in any manner suitable for forming a frame 606 of a suitable geometry for guiding a swing of the user, as previously discussed. Representatively, in this embodiments, the sections 606A-606F and joints 612A-612F form a six sided polygon (or hexagon). In some embodiments, one or more of sections 606A, 606C, 606D and 606F may be longer than one or more of sections 606B and 606C. Alternatively, any of sections 606A-606F may have a same or different size than another section. In addition, in some embodiments, the frame angles formed between sections 606C and 606D and sections 606A and 606D (e.g., joints 612C and 612F) are substantially the same, and the angles formed between sections 606A-606C and 606D-606F (e.g., joints 612A, 612B, 612E and 612D) are substantially the same.

It is contemplated, however, that in some embodiments, any one or more of sections 606A-606F and/or joints 612A-612F may be adjustable such that the size and/or shape of frame 606 (and the corresponding angles) may be adjusted. Representatively, in one embodiment, one or more of joints 612A-612F may be rotating, pivoting, articulating, hinged or the like joints, which allow one section to move with respect to another. For example, as can be seen from the exploded view of joint 612D, in one embodiment, the joint may include a connector 650 having recessed ends dimensioned to receive the protruding ends of the adjacent sections 606E and 606D. In addition, coupling members 652A, 652B (e.g., pins) may be, for example, inserted through the protruding ends and connector 650 to rotatably engage the pieces with one another. This joint configuration may, in turn, allow sections 606E and 606D (or any other section where it is used) to move relative to one another to, for example, increase or decrease the angle at the joint, and in some cases to collapse one section against another to facilitate storage of frame 606.

Referring now in more detail to first and second support members 602 and 604, as previously discussed, first and second support members 602 and 604 are used to support frame 606 above ground, and at the desired angle (e.g., 60 degrees). Representatively, first support member 602 may be connected to one side of frame 606 (e.g., a left side as viewed by the user) and second support member 604 may be connected to another side of frame 606 (e.g., a right side as viewed by the user). For example, first support member 602 may be connected to section 606B, and second support member 604 may be connected to section 606E. First support member 602 may include a vertical support member 602A and a horizontal support member 602B. The vertical support member 602A is connected at one end to frame section 606B, and extends toward the ground, to the horizontal support member 602B. The horizontal support member 602B in turn, extends from the vertical support member 602A at an angle sufficient to support and provide stability to the frame 606. In addition, vertical support member 602A is connected to frame 606 by joint 620 at one end, and to horizontal support member 602B by joint 622 at another end. Second support member 604 may be the same as first support member 602, and include a vertical support member 604A connected to frame 606 by joint 624, and to horizontal support member 604B by joint 626.

Figure 8:
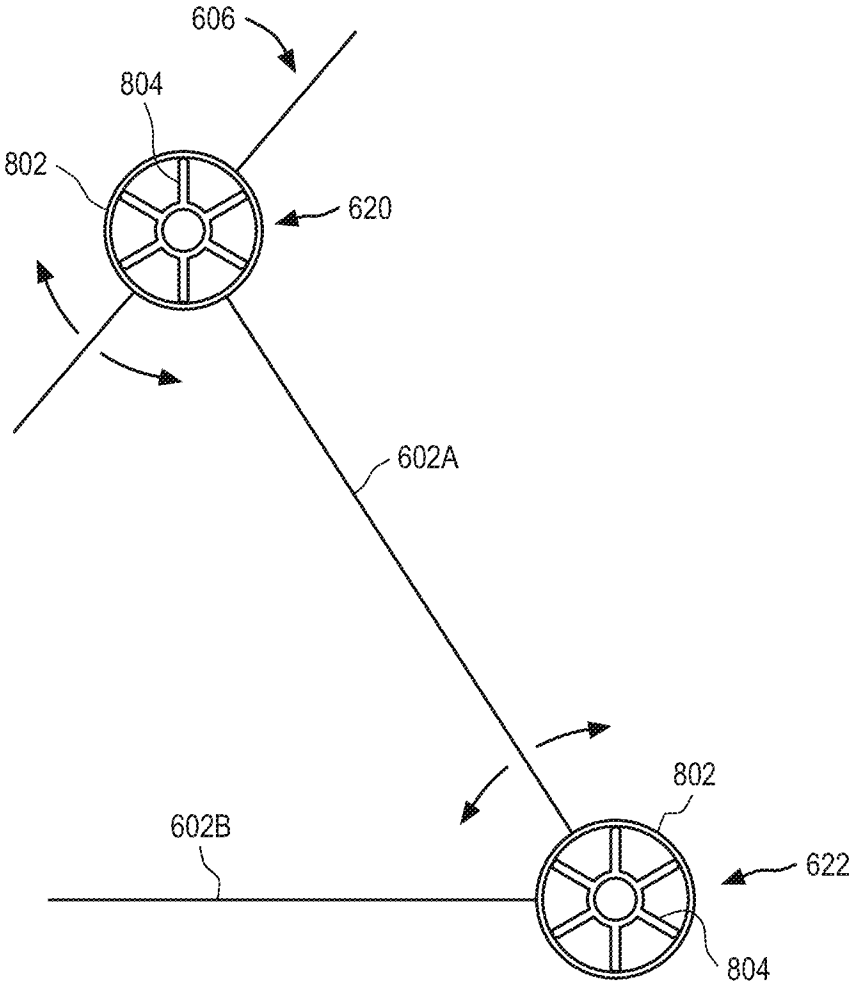
FIG. 8 illustrates a schematic diagram of one embodiment of a support member joint.

In some embodiments, one or more of joints 620, 622, 624, 626 may be articulating, adjustable and/or rotatable joints such that an angle and/or orientation of frame 606 can be adjusted by adjusting one or more of joints 620, 622, 624, 626. Representatively, one or more of joints 620, 622, 624, 626 can be configured to adjust an angle of frame 606 with respect to ground from 30 degrees to 60 degrees, for example, in 5 degree increments. Representatively, one or more of joints 620, 622, 624, 626 can be configured to have, for example, stops at 30, 35, 40, 45, 50, 55, and 60 degrees. Other angles and/or ranges are, however, contemplated. A representative adjustable joint is illustrated in FIG. 8. Representatively, it can be seen from the schematic illustration of FIG. 8 that adjustable joints 620, 622 of one of the support members (e.g., support member 602) which is us may include a receiving portion 802 that receives the adjacent frame section 606 and/or support members 602A, 602B. The receiving portion 802 includes a number of stops 804, which the section 606 and/or members 602A and/or 602B can slide along in a rotating manner as illustrated by the arrows. Once the desired angle is achieved, the sections or members can be locked in position (e.g., such as by a spring locking mechanism), and remain at that position until unlocked by the user (e.g., such as by application of a force). This, in turn, allows for adjustment of any one or more of angles 628, 630, 632 and/or 634, as well as a height of frame 606, to achieve the desired training configuration.

In addition, in some embodiments, first and second support members 602, 604 are connected by a lateral stability bar 640. Lateral stability bar 640 extends horizontally between members 602, 604 and connects to joints 622, 626. Lateral stability bar 640 may further include length extension member 642 such that an overall length of bar 640 can be adjusted to accommodate frames having different widths. Representatively, extension member 642 may be a telescoping portion, or other similar mechanism, that allows for the overall length of bar 642 to be adjusted.

FIGS. 6B-6C illustrate further perspective views of a back side of swing training device 600. From these views, the various angles of frame 606 with respect to ground, as well as support members 602, 604 can be more clearly seen.

Figure 7A:
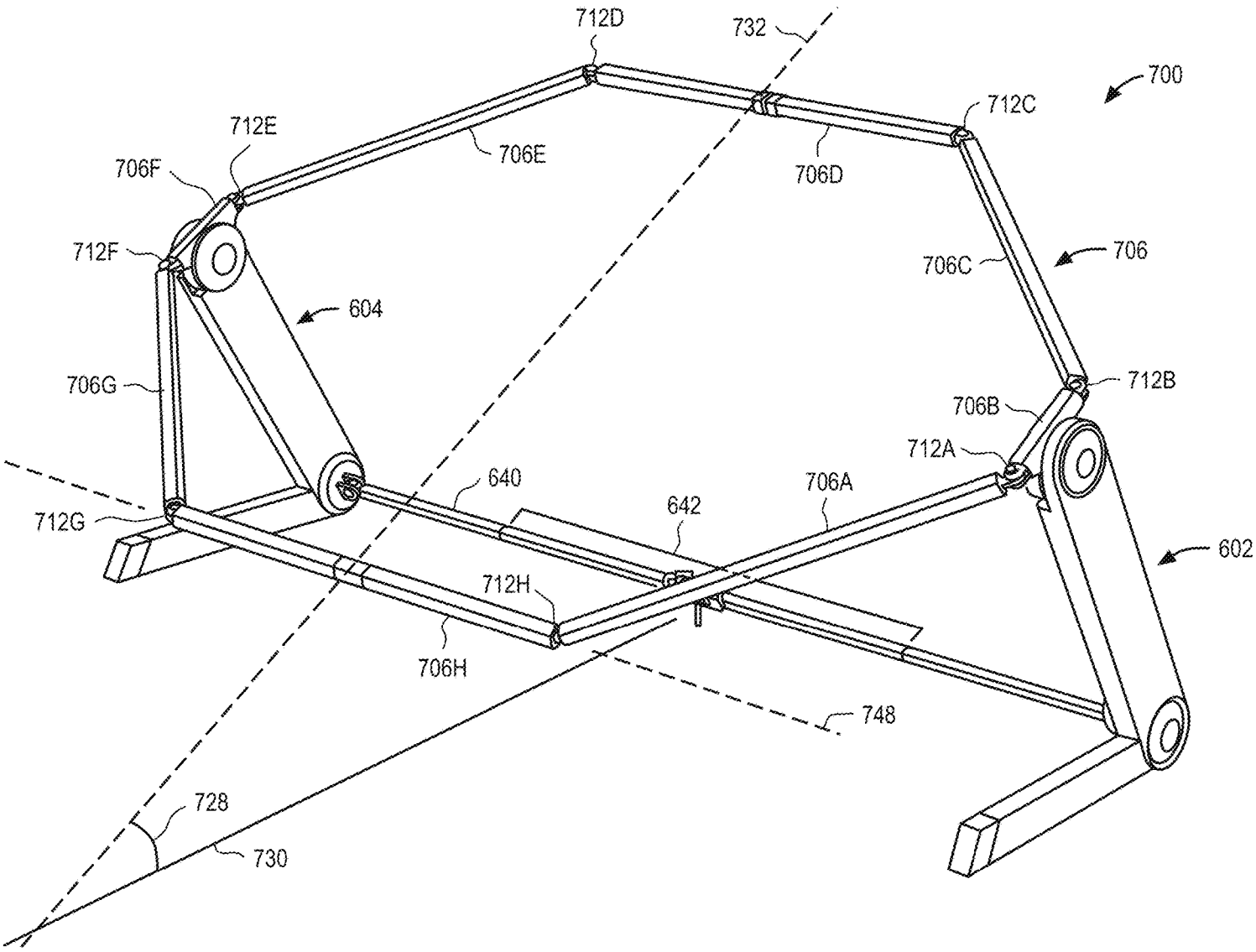
FIGS. 7A-7C illustrate front, back and back side perspective views of a training device.
Figure 7B:
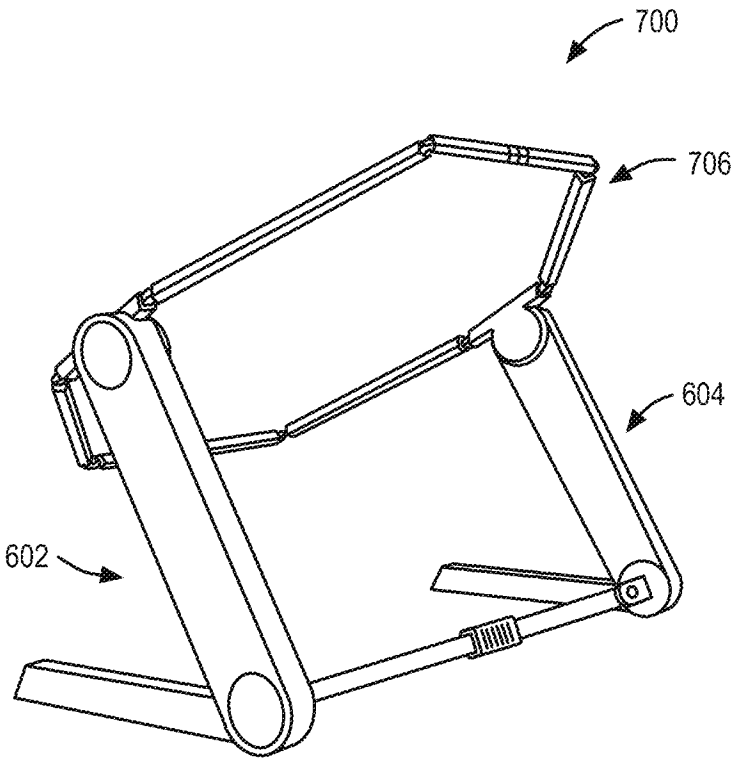
Figure 7C:
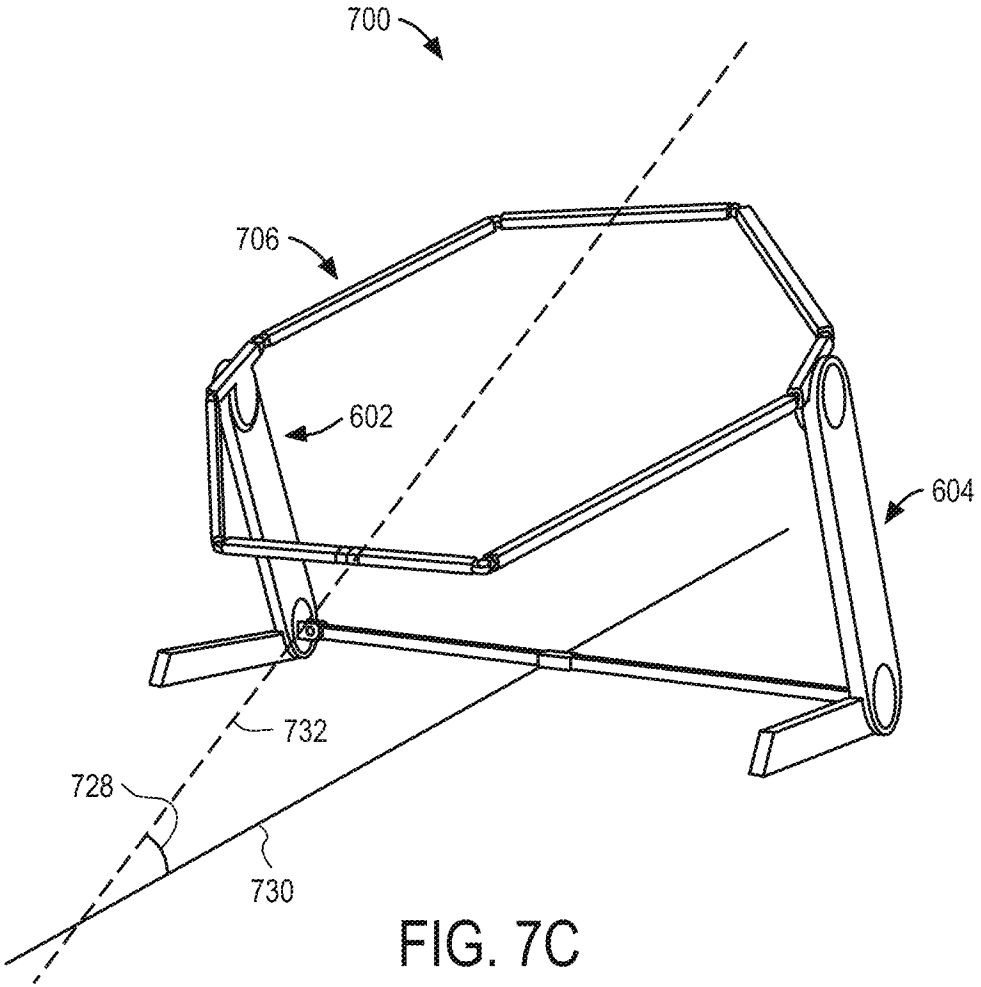

FIGS. 7A-7C illustrate perspective views of another embodiment of a swing training device. Swing training device 700 may be similar to swing training devices 100, 300 and 600, previously discussed in reference to FIGS. 1-4 and FIGS. 6A-6C. Representatively, swing training device 700 may include a frame 706 that is supported by first and second support members that are the same as support members 602 and 604, previously discussed in reference to FIGS. 7A-7C, and are therefore not described again in detail here. In this embodiment, however, frame 706 of device 700 is shown supported at an angle of approximately 30 degrees, as measured between the plane 732 of frame 706 and ground 730 (see angle 728). Frame 706 may, however, be adjustable within a range of 30 degrees to 60 degrees. In addition, frame 706 may be similar to the previously discussed frames, except in this embodiment, frame 706 may include eight sections 706A, 706B, 706C, 706D, 706E, 706F and 706G connected by joints 712A, 712B, 712C, 712D, 712E, 712F, 712G and 712H. Sections 706A-706G may be connected by joints 712A-712H in any manner suitable for forming a frame 706 of a suitable geometry for guiding a swing of the user, as previously discussed. Representatively, in this embodiment, the sections 706A-706G and joints 712A-712H form an eight sided polygon (or octagon). In some embodiments, one or more of sections 706A, 706C, 6706D, 706E, 706G, 706H may be longer than one or more of sections 706B and 706F. Alternatively, any of sections 706A-706H may have a same or different size than another section. In some cases, frame section 706D can form a top line and frame section 706H can form a bottom line, where the top line and bottom line are parallel to a lateral axis 748 (an axis from side to side, as shown in FIG. 7A). In addition, in some embodiments, the frame angles formed between one or more of sections 706A-706H may be the same or different. In addition, any one or more of sections 706A-706H and/or joints 712A-712H may be adjustable such that the size and shape of frame 706 (and the corresponding angles) may be adjusted as desired.

Support members 602, 604, as previously described in reference to FIGS. 6A-6C are connected to the left and right sides of frame 706 at sections 706B and 706F, respectively. In addition, FIGS. 7A-7C illustrate bar 640 with extension member 642 in an expanded configuration to accommodate the wider frame 706 shape shown in FIGS. 7A-7C.

It should be understood that any components, pieces or sections of the embodiments shown in FIGS. 1-4, FIGS. 7A-7C and FIGS. 6A-7B can be shared and/or are interchangeable between the various structures to achieve a training device having a different shape, dimensions and/or configuration. For example, any of the frames 106, 306, 606 and/or 706, may be interchanged with the various support systems and/or adjusted to an angle within a range of 30 degrees and 60 degrees relative to ground to achieve the desired training system.

Folding/Collapsing System

Figure 10:
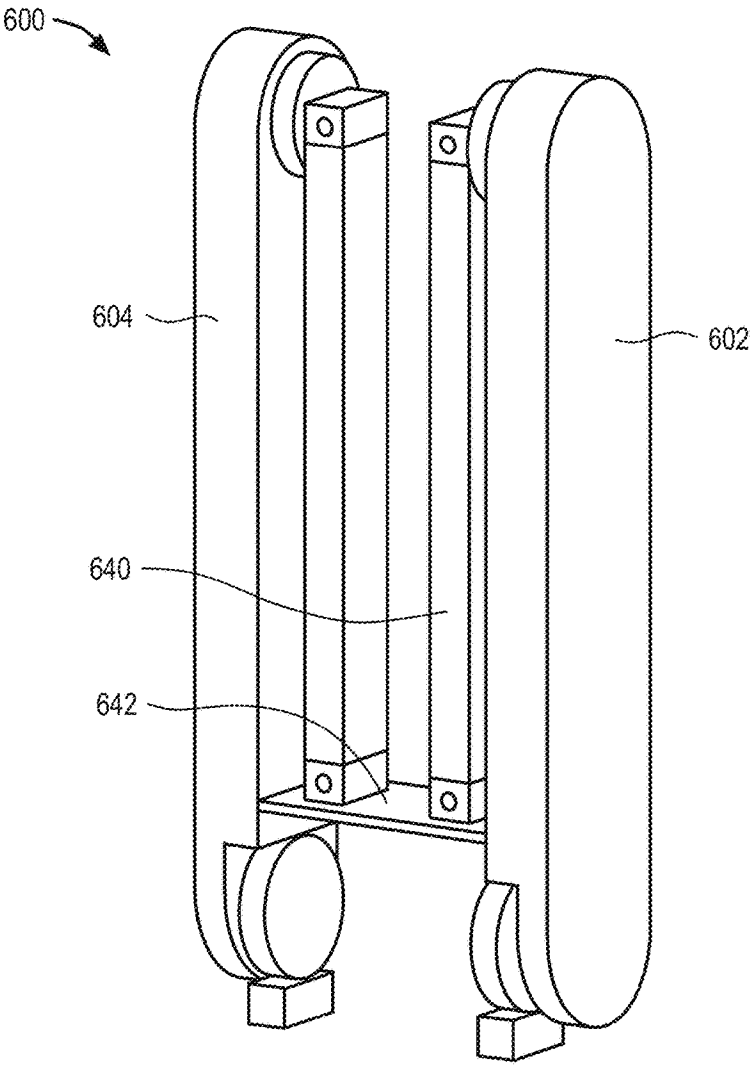
FIGS. 9-10 illustrate perspective views of a collapsed swing training device.
Figure 9:
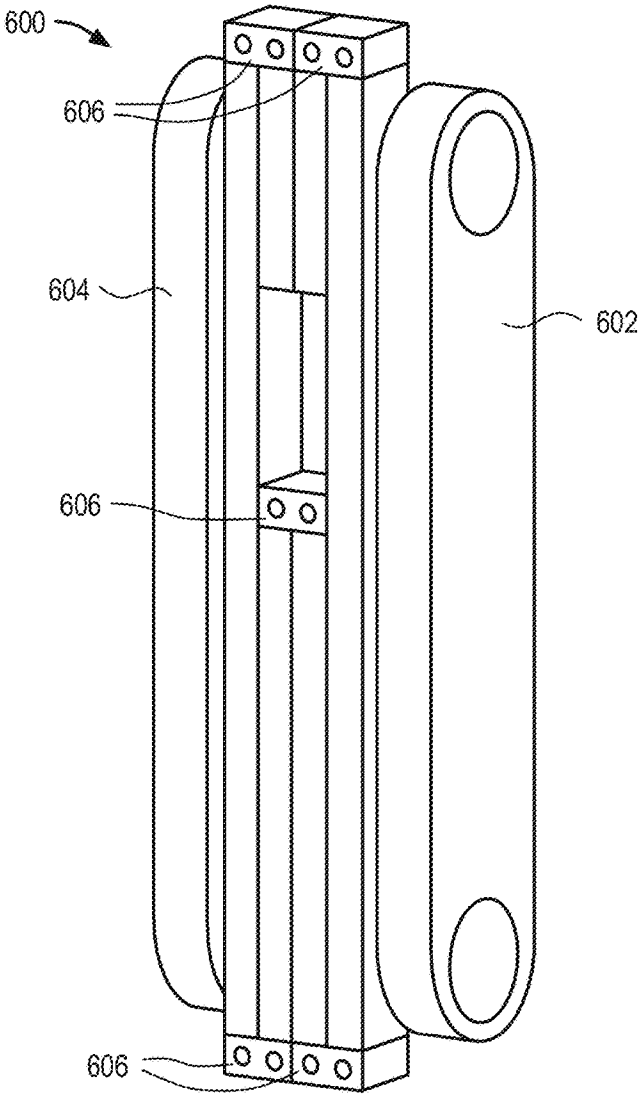

In some embodiments, the swing training devices disclosed herein (e.g., devices 100, 300, 600 and 700), can be collapsed and/or disassembled for compact storage, for example, in a carrying case. Representatively, any one or more of the previously discussed polygon frames may be removed from their respective support members, and then each of the frames and support members collapsed onto itself to form a collapsed or folded device that can be stored in a compact carrier as illustrated in FIGS. 9-10. For example, as shown in FIGS. 9-10, the polygon frame 606 previously discussed in reference to FIGS. 6A-6C can be a folding polygon frame, with sections 606A-606F joined at folding joints 612A-612F. Once training is completed, frame 606 can be removed from support members 602 and 604, and sections 606A-606F can be folded, or otherwise collapsed onto each other into the collapsed configuration shown in FIG. 9. Similarly, the lateral stability bar 640 can have one or more folding or separable joints, for example, at the extension member 642, such that bar 640 can be separated and/or folded in half. In addition, the members 602A-602B and 604A-604B of support members 602 and 604, respectively, can be separated, folded or collapsed onto each other at joints 622, 626, to achieve a collapsed configuration as shown in FIG. 10. The collapsed frame 606 and support members 602-604 can then be stowed together, for example, in a carrying case or other portable carrier suitable for transporting the training system. In this manner, the swing training device is a foldable/collapsible and portable swing training device, having folding joints to provide a compactable body for storage or transport, as shown in FIGS. 9-10.

Figure 11:
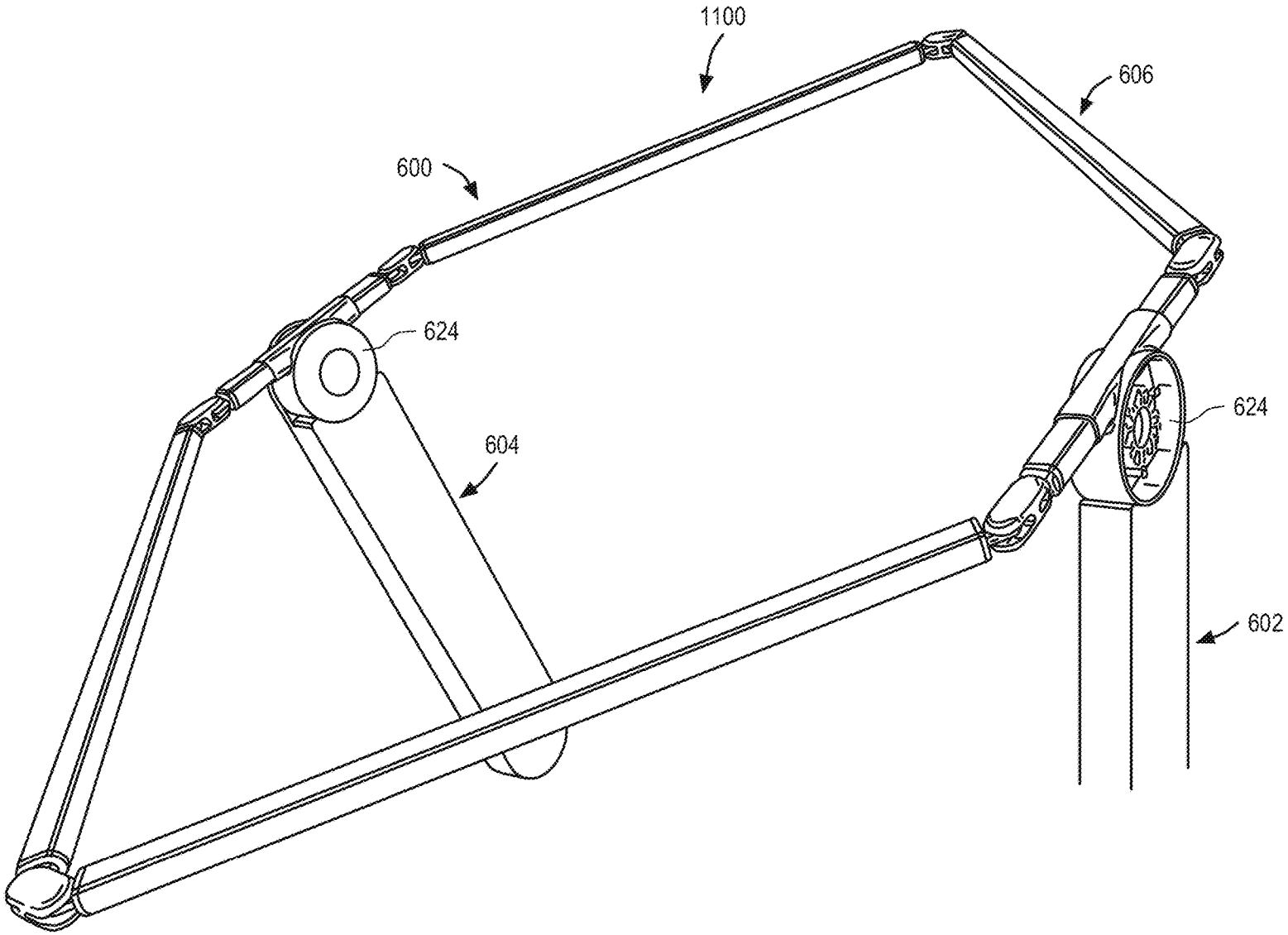
FIGS. 11-15 illustrate perspective views of the operations for collapsing the swing training device.
Figure 12:
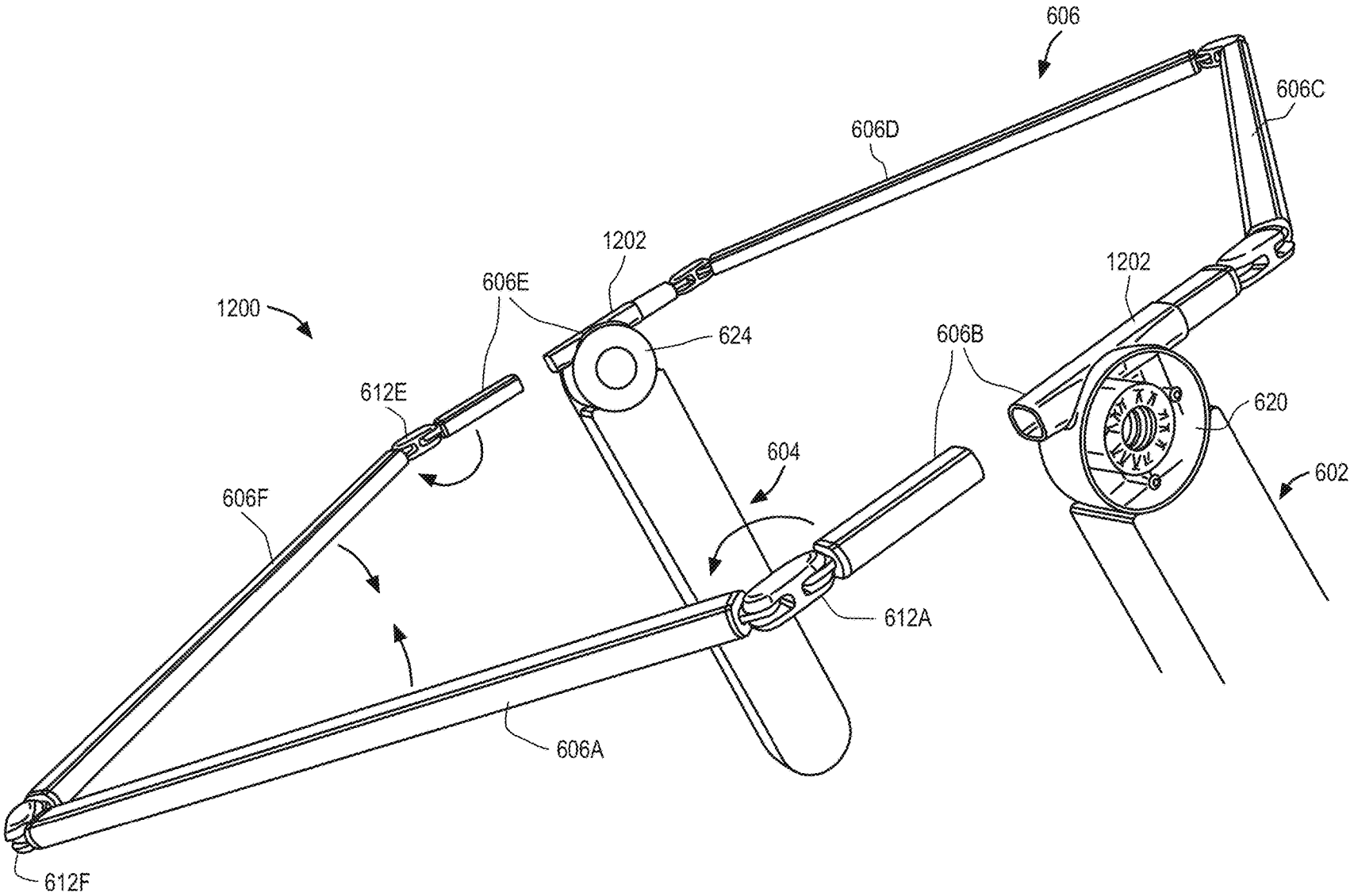
Figure 13:
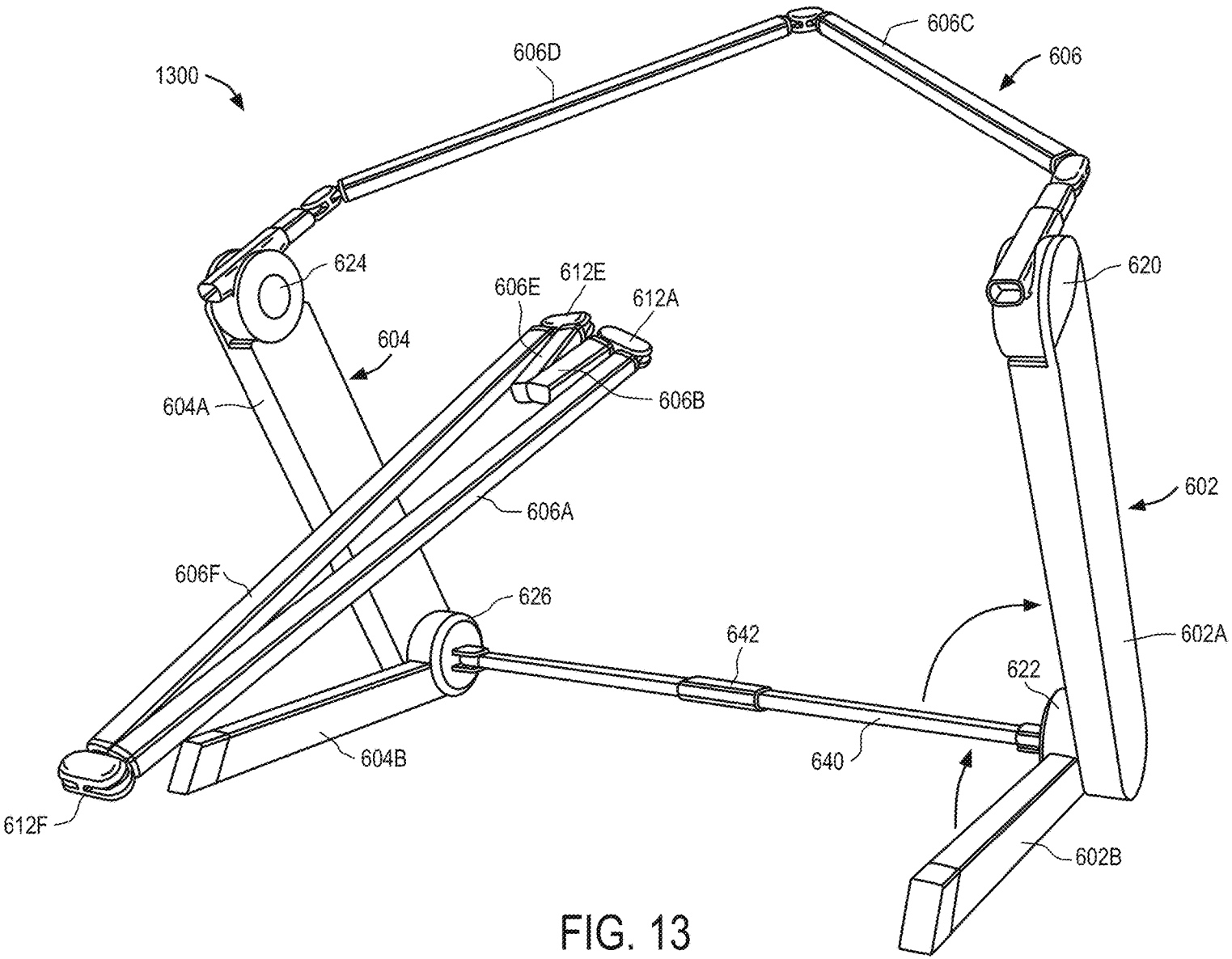

One exemplary series of operations for transitioning a training device into a collapsed configuration as shown in FIGS. 9-10 will now be described in reference to FIGS. 11-15. Representatively, FIGS. 11-15 illustrate perspective views of a series of operations for transitioning the swing training device 600 to the collapsed configuration of FIGS. 9-10. FIG. 11 illustrates operation 1100 in which a training operation is complete and the swing training device 600 is in the training configuration, as previously described in reference to FIGS. 6A-6C, and ready to be stored. FIGS. 12-13 illustrate operations 1200 and 1300 for collapsing frame 606. Representatively, in operation 1200, sections 606B and 606E are first separated from support members 602 and 604, respectively, and in turn, the remaining half of the frame 606. In one embodiment, sections 606B and 606E are each composed of two separable pieces having interfacing ends that are connected at the support member joints 620 and 624, respectively. For example, the interfacing ends may be inserted into a connection tube 1202, or other similar structure, which is attached to the ends of support members 602, 604 near joints 620, 624. To connect or separate the different pieces to form the sections 606B, 606E, the ends of each piece are either inserted into, or removed from, connection tube 1202.

As further shown in operations 1200-1300, once the ends of sections 606B and 606E are free, and sections 606B and 606E, are folded inwardly toward, or otherwise collapsed onto, sections 606A and 606F, at joints 612A and 612E, respectively, as shown by the arrows. In addition, sections 606A and 606F are folded toward, or otherwise collapsed onto, each other, as shown by the arrows. Sections 606C and 606D, along with the remaining pieces of sections 606B and 606E, can also be removed from support members 602 and 604, and folded or otherwise collapsed onto each other in a similar manner (see FIG. 15).

Figure 14:
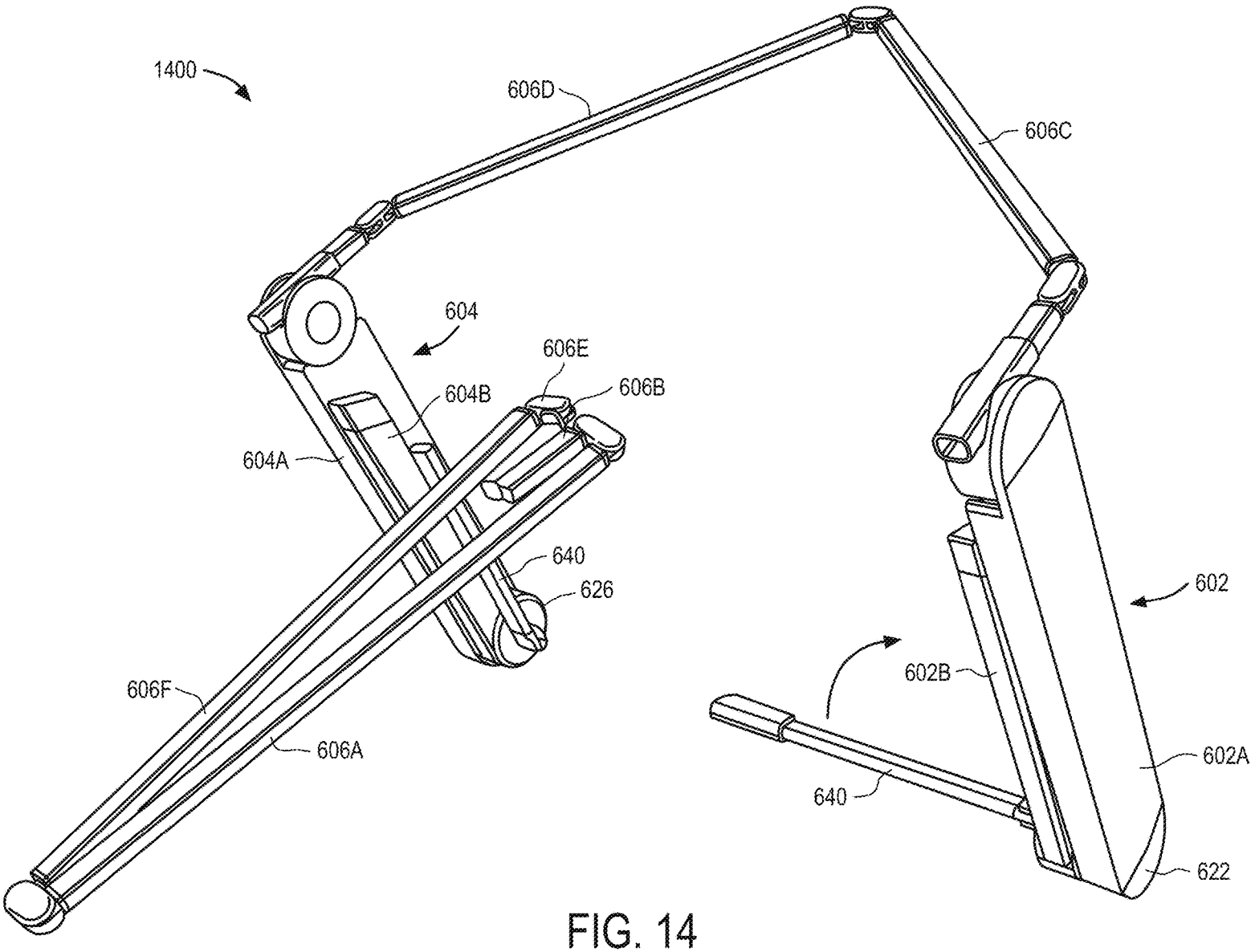
Figure 15:
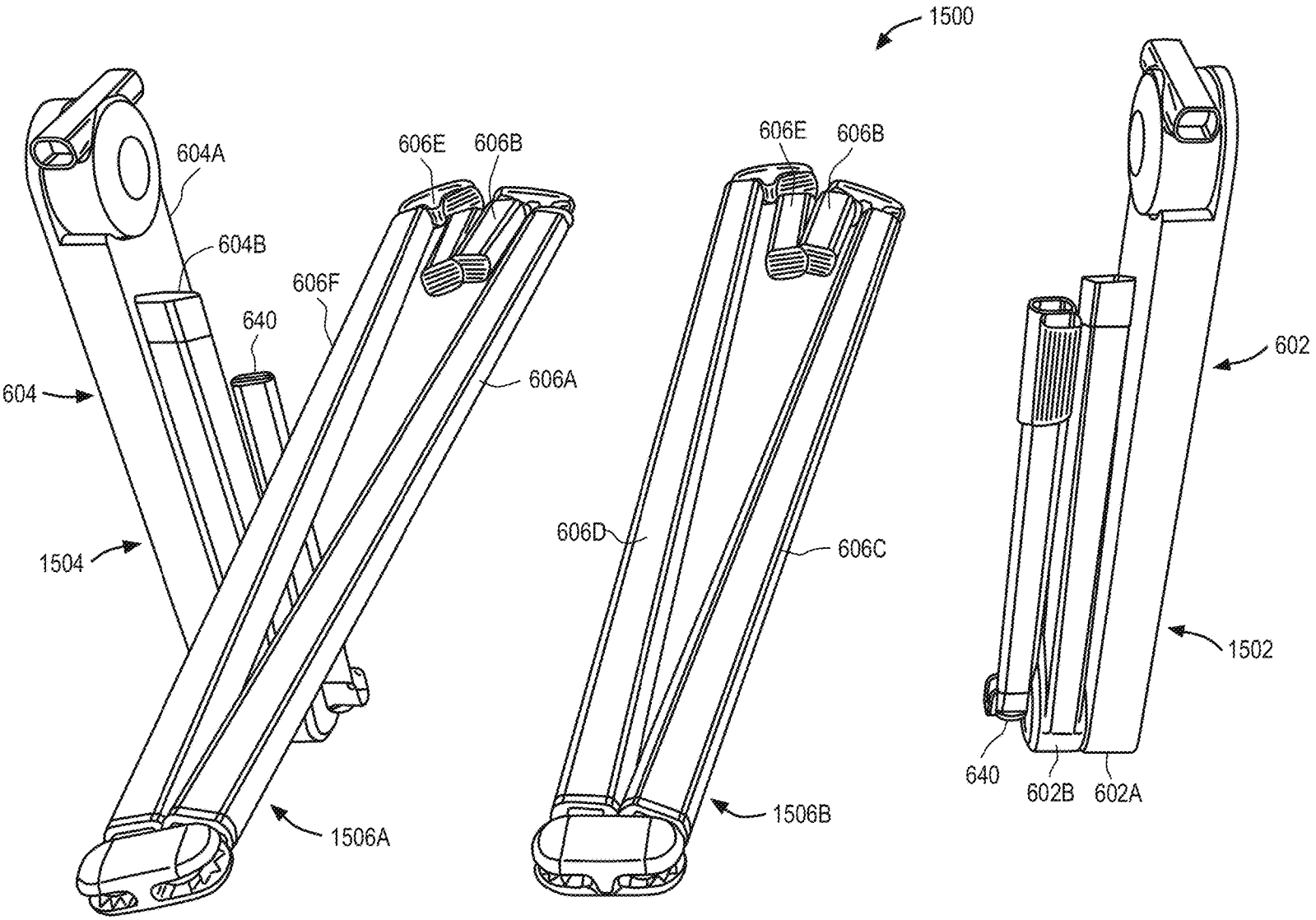

In addition, FIG. 13 in combination with FIG. 14 illustrates an exemplary operation 1400 for folding, or otherwise collapsing, the support members 602 and 604. Representatively, each of the horizontal support members 602B, 604B of support members 602 and 604, can be folded upwardly toward the vertical support members 602A, 602B at joints 622, 626, respectively, as shown by the arrows. In addition, the lateral support bar 640 connecting member 602 to member 640 can be separated into two pieces at extension member 642. Each of the interfacing free ends of bar 640 can then also be folded upwardly toward vertical support members 602A, 602B. In this aspect, it is contemplated that the ends of bar 640 are attached to support members 602 and 604 by a movable joint, for example a rotating, articulating, hinged, adjustable, or the like joint, so that they can be folded upwardly toward the vertical support members 602A, 602B. The collapsed or folded configuration of each of the support members 602, 604, as well as the frame 606, is shown in operation 1500 of FIG. 15. Once each of the components are collapsed, or otherwise folded, into the collapsed configuration as shown in operation 1500, they can be assembled together into a collapsed swing training device as illustrated by FIG. 9. For example, each of the collapsed frame portions 1506A, 1506B of FIG. 15, can be positioned between each of the collapsed support member portions 1502, 1504, and secured together resulting in a compact and portable training system that can be transported easily to any desired training location by the user or trainer.

It should be understood that while FIGS. 11-15 illustrate the operations for collapsing the swing training device 600 of FIGS. 6A-6C, it should be understood that any of the previously discussed swing training devices (e.g., devices 100, 300 or 700) may be collapsed in a similar manner to the collapsed configuration.

Various aspects of the previously discussed swing training devices, and how they are used to train the swing of a user, will now be discussed in more detail.

Posture

In one embodiment, in order to use the device and embodiments shown herein, a proper grip must be established. This can be either an interlocking grip, an overlapping grip or a baseball grip, known grips for holding golf clubs. The end user will be able to make this decision on their own and it just becomes a matter of preference.

After the grip has been established, the next step is to learn to get into the proper stance and posture/set up position, to start the golf swing.

Referring now to FIG. 5, the removable posture pole 508 can be inserted and removed from the frame and/or support base (e.g., vertical member 124 and/or any one of frames 106, 306, 606 or 706). For example, the posture pole 508 is detachable and can be removably connected to a back side of the frame or support members such that it is tilted forward at an angle designed to get into the correct stance and posture.

Posture Pole Insert Area

To get into the proper stance and posture to the user then steps inside the frame, and in the middle of it; while standing up straight. While standing in the middle of the frame the outsides of each respective hip should be parallel to and in the middle of the side sections when frame is at a 30 degree angle (e.g., sections 106B, 106E of frame 106 and sections 706B, 706F of frame 706); when in the frame at the 60 degree angle, the outsides of the hips will be parallel to and in the middle of the side joints (e.g., joints 312A, 312E of frame 306 and joints 612A, 612E of frame 606).

The next step is to move backward just a couple of inches until, in embodiments where a posture pole is used, the top of the posture pole is slightly touching the upper part of the back in the middle. Also when done correctly, the knees should be parallel and slightly behind the front joints in the 30 degree model (e.g., joints 112A, 112E of frame 106, and joints 712A, 712B of frame 706); in the 60 degree frame, the knees would be parallel to the joints (e.g., joints 312A, 312D of frame 306 and joints 612A, 612E of frame 606). If the user draws a straight line, in their mind, from the converging points in between the relevant joints, they will see where they need to be slightly behind and parallel to these referenced points with their knees, while the posture pole is slightly touching the upper part of the back and in the center.

The next step is to get into a balanced stance; when doing this, the user may slightly flex the knees and have the heels of the feet approximately shoulders width apart with the lead foot flared open at 22.5 degrees and the back foot flared open at 7.5 degrees from the heels, while still maintaining contact with the posture pole in the upper center of the back. The heels of both feet will now be set in the proper position, and the position can be checked using, in the case of training devices 100 and 200, the foot guides 118A-118B and 318A-318B, respectively.

While in this position the user should feel down pressure (not weight) in the left, lead foot, of 60 to 70 percent, and down pressure (not weight) of 30 to 40 percent in the right, or back foot. This down pressure (not weight) of the feet is allowing the user to feel the connection of the feet and the ground they are standing on. While feeling this down pressure (not weight) in both feet the user will achieve the proper 50/50 balance in the upper and lower body. When the down pressure (not weight) of the feet are connected to the ground in the manner described above, the user will feel their weight (not down pressure) in their heels, with slight pressure in the balls of both feet, with a sense of air underneath their toes of each respective foot. Once this is achieved, the user can also check to make sure they are in a proper athletic stance by checking to see if their hips and shoulders are parallel or square with the vertical support members, for example, members 110 and 310 of devices 100 and 300, respectively.

Stance Sequence

Figure 17:
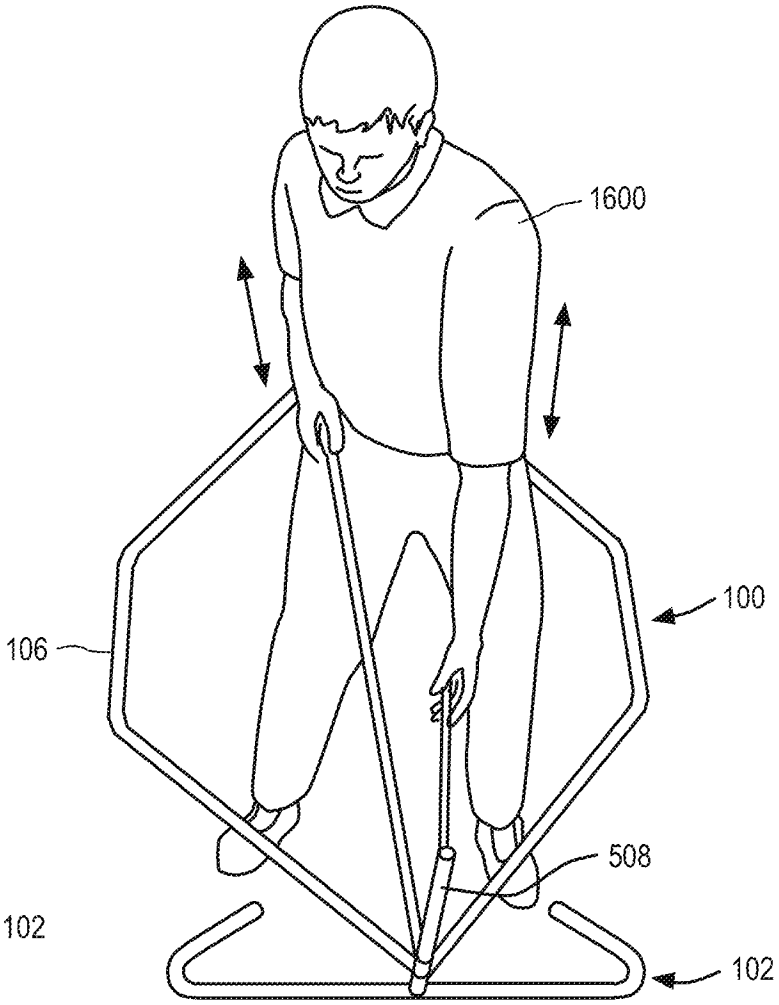
FIG. 17 illustrates a perspective view of the use of a front posture pole of a swing training device.
Figure 16:
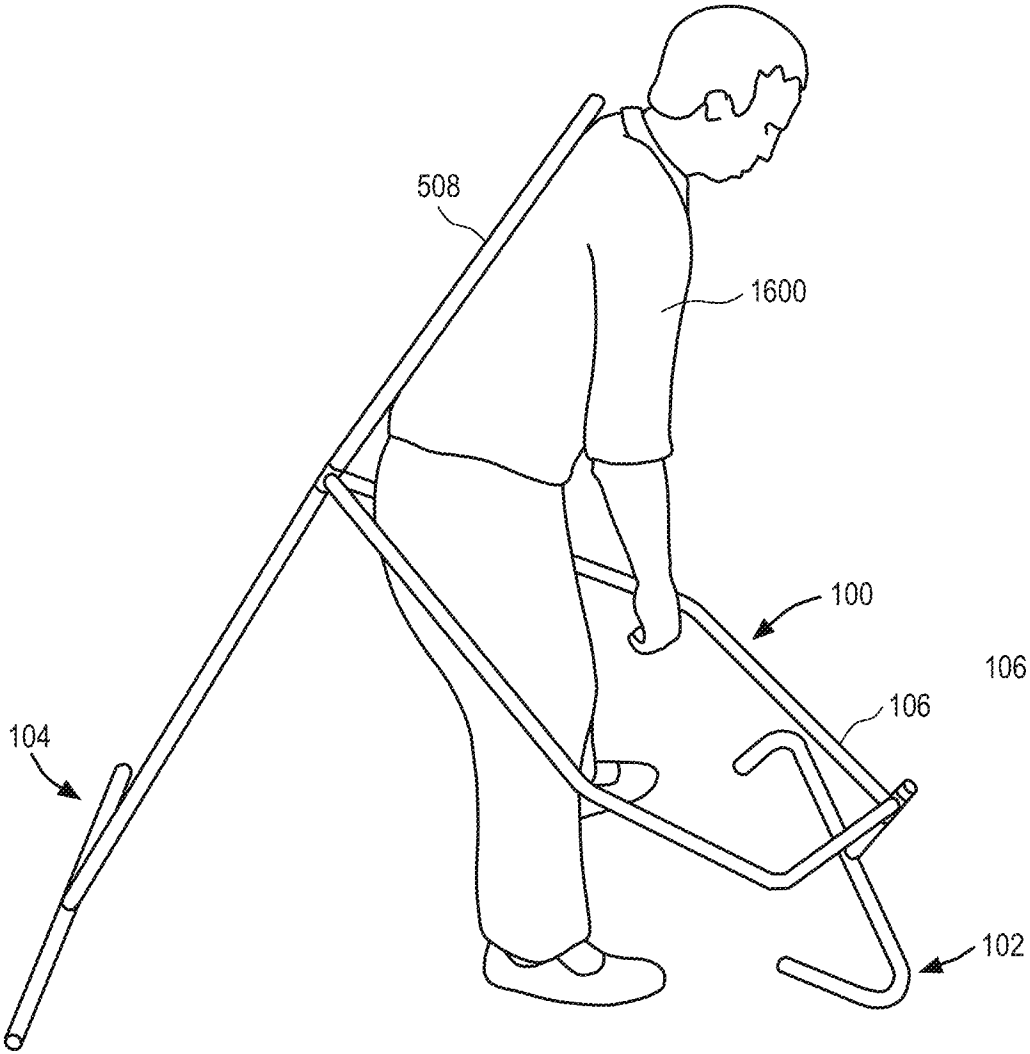
FIG. 16 illustrates a perspective view of the use of a rear posture pole of a swing training device.
Figure 18:
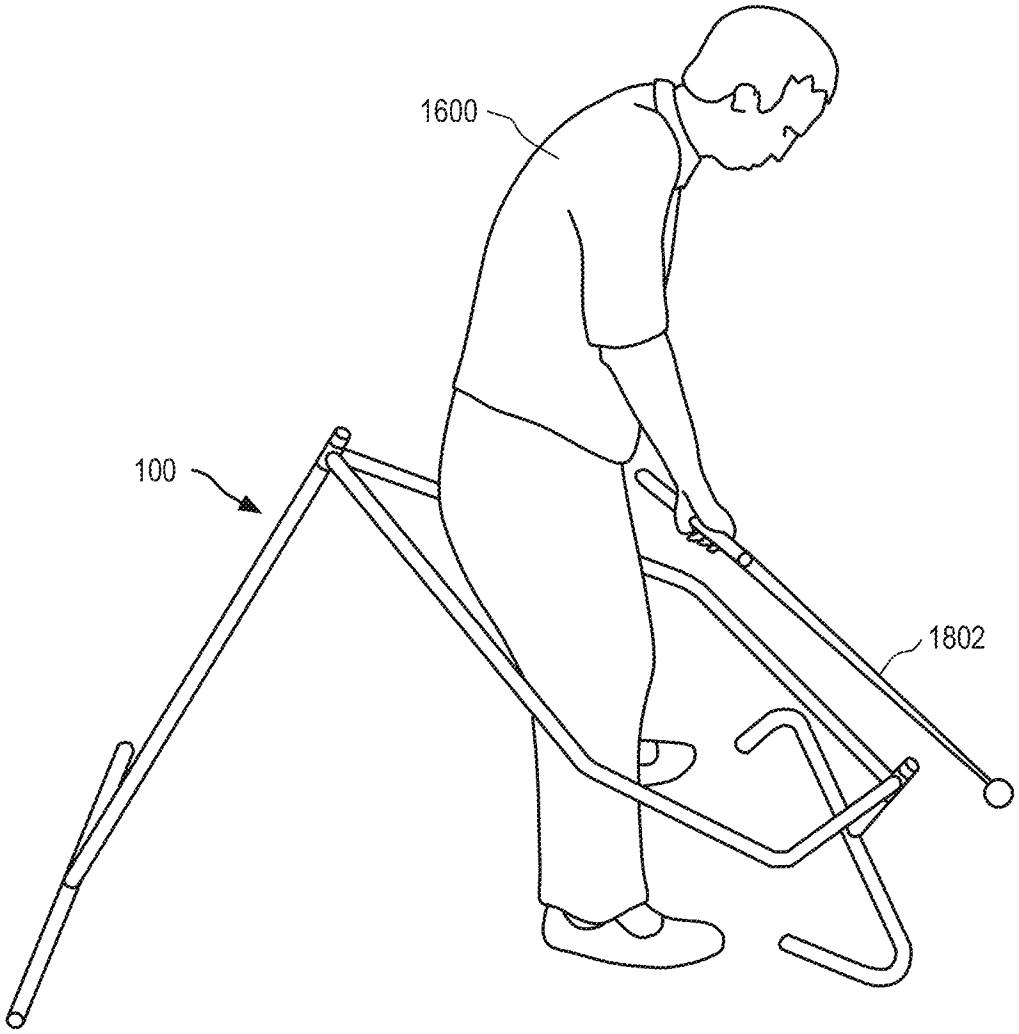
FIG. 18 illustrates a side perspective view of the use of with a swing training device for training a golf club.

The proper stance, posture and swing sequences will now be described in reference to FIGS. 1-4 and FIGS. 16-18. Representatively, FIGS. 16-17 illustrate how the addition of the posture pole 508 to the swing training device (e.g., device 100) can train a proper stance and posture of the user 1600, and FIG. 18 illustrates how, once the proper stance and posture is achieved, user 1600 can incorporate a club 1802 into the training sequence. For example, to get into the proper posture the user can, from the starting point of a balanced stance, take one step backwards with both the left and right foot while maintaining contact with the posture pole 508 in the upper part of the back. When this is done correctly the maintaining of the contact with the posture pole on the upper part of the back, will cause the spine to start tilting forward. To continue; the user can now raise their hips up and back, until the lower part of the back is touching the lower part of the posture pole. When done correctly, the user will feel as though they are in a very strong athletic bowing position and this will also cause the user to have their knees slightly flexed, and inline with the ankles, as the spine of the back will be tilted forward from this movement. Also, by doing this correctly the user will lose contact with the upper part of the posture pole. The next step is to now raise the upper part of the back or chest independently until the upper part of the back is touching the posture pole while maintaining contact with the lower part of the posture pole with the lower part of the back. And the final part to getting into proper posture is to just let the arms hang freely from the shoulders and double check to make sure the pressure and weight in the feet are set correctly as mentioned previously above.

After the arms are hanging freely from the shoulders, and the pressure and weight are set correctly in the feet, is the user may now move the right hand in the direction and parallel to the forward frame joint on the right side (e.g., joint 112E of frame 106 and joint 712F of frame 706) and the left hand in the direction and parallel to the forward frame joint on the left side (e.g., joint 112A of frame 106 and joint 712A of frame 706) for the 30 degree frame; for the 60 degree frame the right hand would move in the direction and parallel to the forward frame joint on the right side (e.g., joint 312D of frame 306 and joint 612E of frame 606) and the left hand would move in the direction and parallel to the forward frame joint on the left side (e.g., joint 312A of frame 306 and joint 612A of frame 606), until the hands are in front of and in the center of the body slightly touching each other. The last step to this process is to rotate the right forearm clockwise and the left forearm counterclockwise until the palms of each respective hand are facing each other and touching flat against each other and directly under the shoulders.

When all of this is done correctly it will now place the spine of the user at a 60 degree angle tilted forward, while the lower body will be in the correct position to support the forward tilt of the spine. It will also get the arms and hands in the correct position to start the swing. By rotating the forearms clockwise and counterclockwise (respective forearms) it will now get the elbows in the correct starting position to where they will be pointing directly at the inside part of the hip sockets and in front of the body, while the hands will remain/or be placed underneath the shoulders. Thus, resulting in an athletic posture and stance, which will allow the user to achieve a sense of balance and being centered before starting the swing.

Once the proper stance sequence is achieved, the posture pole 508 can be moved to the front of the frame for further training without a club (as shown in FIG. 17) or removed all together for training with a club 1802 (as shown in FIG. 18)

Weight Shift—Backswing Movement of Body

Representatively, in order to achieve the proper weight shift the user can remove the posture pole 508 from the back of the frame and insert it into the connection piece at the front of the frame, as shown in FIG. 17. Thus, as shown in FIG. 5, and FIGS. 17-18, the user may advantageously and beneficially use the top part posture pole 508 to train weight shifting and backswing movement, by coupling the pole to the front of the polygon.

Once the insert has been connected properly, the user can take a rope/band/string and wrap it around/flip it over and around, the detachable posture pole while still holding the ends of the rope/band/string in each individual or respective hand. See, for example, FIG. 17.

Then when in the proper posture and with the arms hanging freely from the shoulders and the hands and arms in the correct starting position to start the swing, the user will hold the respective rope/band/string ends, in each respective hand. From this position the user will bend/fold the arms upward slightly from the elbows, while hanging onto the rope/band/string ends, until both hands are approximately 4 to 6 inches above the height of the knees of each respective leg. It is the folding of the elbows that must move the hands above the height of the knees and not the hands.

Once this movement has been achieved, the user will then pull the rope/band/string end back with the right hand towards the outside of the right/back/trail hip, keeping the right hand and elbow as close to the body as possible when making this movement to understand the necessary centered shift of the backswing. As the right hand is pulling back the end of the rope/band/string end in the right hand, the right elbow will be moving back in the direction and parallel to and above, for example the frame section 106E of frame 106, and then parallel to and above the frame section 106D when frame 106 is at a 30 degree angle as shown in FIGS. 1-2; where the frame is at a 60 degree angle as shown in FIGS. 2-3, for example, frame 306, the right elbow will move straight back in the direction of the joint 312C parallel and above, then back in the direction of section 306D parallel and above in a slight upward angle. Simultaneously in both models the right shoulder will follow the direction of the right elbow moving in the direction and parallel above to section 106E and then the frame section 106D in the 30 degree model and the joint 312C and then section 306D for the 60 degree model, to complete the backswing shift with the right side of the upper body. When the backswing shift has been completed the chest and upper torso will now be parallel with section 106 in the 30 degree model, and section 306E of the 60 degree model. See, for example, FIG. 17.

As the right hand and arm are pulling the end of the rope/band/string end, back with the right hand, the left hand, holding the other end of the rope/band/string end, will move in the direction of sections 106A and 106A in both the 30 degree and 60 degree models, as this is happening with the left hand, the left elbow will move in the direction of section 106B in the 30 degree model and in the direction of joint 312F of the 60 degree model. Then sections 106A, 106A in the 30 and 60 degree models. The left shoulder will follow the same path as the left elbow, simultaneously, and follow in the direction of sections 106A and 106B in the 30 degree model and in the direction of joint 312F and 306A in the 60 degree model. At the completion of the backswing shift, the left hand, left arm, left elbow and left shoulder will all be above and parallel to sections 106A and 306A in the 30 degree and 60 degree models, respectively. When the shift is completed the entire left arm will now be parallel to and above sections 106A and 306A for both models.

This shifting motion should not be done by the upper body alone. Rather, it should be done and governed by the movements in the lower body, while the upper body is making the motions as described above. While making this motion with the right hand the user must use the lower body to make this happen. How this is done (after being set up correctly) is by pushing the right/trail knee straight back parallel to and above, in the direction of section 106E and back to the joint 112D, when the right/trail knee has moved to this point, it will then continue to move back slightly in the direction of section 106D in the 30 degree model. In the 60 degree model, this movement will be back in the direction of joint 312C and then slightly back in the direction and parallel to section 306D. This will cause the right/trail knee to move back and get positioned over the right heel/trail heel.

By moving the right/trail knee back as described above will allow the right hip/trail hip to move back and at an upward angle in the direction and parallel to section 106D for the 30 degree model and section 306D for the 60 degree model as the right/trail hip will follow the movement of the right/trail knee. This movement must be done right up to the point of the entire right leg straightening, (there still needs to be a minimum amount of flex in the right/back/trail knee when the shift is fully completed) to maximize the shifting movement and angular load in the lower body.

While this movement is being done with the right/back side of the lower body the left knee/lead knee will be moving towards section 106A slightly below the converging point of joint 112A of frame 106 and towards the big toe of the left/lead foot, in the 30 degree model and towards section 306A slightly below joint 312A and in the direction of the big toe of the left/lead foot, in the 60 degree model. The left/lead hip will be moving slightly down at an angle in the direction of section 106C of frame 106 in the 30 degree model and section 306B of frame 306 in the 60 degree model. When this movement is done correctly the left/lead knee will be positioned over the ball joint of the left/lead foot and the left/lead hip will be positioned directly over the top of the left/lead heel.

While the lower body is moving in its respective positions following the guides in both the 30 degree and 60 degree models; the upper body will follow the movements of the lower body without turning. Thus, causing the right/back shoulder to move back on a slight upward angle in the direction of sections 106E of frame 106 and then back in the direction to, at a slight upward angle and parallel to section 106D of frame 106. The left/lead shoulder will move down, at a slight angle and parallel, in the same direction as section 106B of frame 106 and then down in the direction and parallel to section 106A of frame 106 at an angle in the 30 degree model; causing parallel moves to take place simultaneously.

In the 60 degree model this movement would be the right/trail shoulder moving back and parallel to, in the same direction as joint 312C at a slight upward angle and then moving back and parallel to 306D. The left/lead shoulder to be moving down slightly in the direction of joint 312F of frame 306 then in the direction of section 306A at a slight downward angle, thus causing parallel movement to happen simultaneously. The effect is that the shoulders will now be moving parallel to each other inside of the guides of the training device at all times.

When the backswing shift has been completed by following the directions above, the body will be centered, and the user will feel the weight of their body primarily in the heels of their feet with a slight sensation of weight in the ball joints of the feet as well. This causing the user to feel 60-70 percent pressure in the left/lead foot and 30-40 percent pressure in the right/back foot. 50/50 balance of the body while staying centered will be achieved. Also, the chest and the hips will now be parallel to sections 106F and 306E of frames 106 and 306, respectively, in both the 30 degree and 60 degree models and the buttocks/gluteus maximus and back will now be parallel to section 106C of frame 106 in the 30 degree model and to section 306B of frame 306 in the 60 degree model.

Weight Shift—Downswing Movement of Body

To begin the downswing shift, the user starts from the completed position of the backswing shift. When starting from the completed position of the backswing shift the user will pull with the left/lead hand the rope/band/string end back to the outside of the left/lead hip, again this movement needs to be done with the left/lead hand and elbow remaining as close to the body as possible.

Even though the user will be pulling back the rope/band/string end with the left/lead hand this downswing shift movement needs to be initiated with the correct movements of the core and the lower body, as the downswing shift is slightly different than the path of the backswing shift.

The core and lower body movements necessary to start the downswing shift are started by the stomach/belly button/center moving in the direction and parallel to section 106F and then to section 106A and then section 106B and if the user is flexible enough in the direction of 106C of frame 106, in the 30 degree model. The sequence of the stomach/belly button/center in the 60 degree model is the center starts moving in the direction of section 306E and then section 306A and then to section 306B. These movements of the center need to be happening rapidly. As this is happening with the core/center, the left/lead knee is moving back to the left heel, in the same direction and parallel to section 106C in the 30 degree model and section 106B in the 60 degree model; as this is happening the left/lead hip is moving in an inline relationship with the left/lead knee and in the same direction and parallel to section 106C of frame 106 in the 30 degree model and section 306B of frame 306 of the 60 degree model.

While the left knee/lead knee and left/lead hip are moving back in the direction of section 106C at an upward angle in the 30 degree model, the right hip/trail hip will be moving back and slightly down and parallel, at an angle to section 106D, while the right knee/trail knee will be moving slightly down in the direction of section 106E. When the right knee becomes parallel with joint 112E of frame 106 the right knee will rapidly change directions and then start moving in the direction of section 106F at a slight downward angle and parallel. As this rapid direction change is taking place the weight in the right/trail foot is moving from the heel to the ball joint of the right/trail foot. While the weight is moving to the ball joint of the right/trail foot the user must allow the right/trail heel to come off the ground. This will put the majority of the weight of the right/trail side of the body in the ball joint of the right/trail foot. While the majority of the weight of the left/lead side of the body will be back in the left/lead heel.

Once at this position the right/trail heel will be two to three inches off of the ground. When the right/trail knee reaches the vertical member 110 of frame 106, as it has continued to move in a slight downward angle parallel to section 106 to reach this point. From here the user must start the pivot of the ball joint of the right/trail foot, while starting this pivot move the right/trail ankle (outside part of the ankle) will move in the direction of and parallel to the support members 116A-116B of support member 102, of device 100. This pivot action will allow the right/trail knee to change directions and continue in the direction and parallel to section 106A at a slight upward angle. As the pivot completes and the right/trail foot is extended upward from the ground onto the big toe of the trail foot. The right knee will continue to move in the direction and parallel to the joint 112A, and finally come to rest just above and parallel to the joint 112A, of frame 106. At this position, the left hip/lead hip will have moved back at an upward angle in the direction of section 106C and come to rest at the joint 112C of frame 106 while the right hip will have come to rest parallel to and at a slight downward angle to the support members 116A-116B. Also when in this completed position the center of the pelvis will be facing the center of section 106B at a tilted angle or section 106C depending on the user's flexibility. Thus, completing the downswing shift of the lower body in the 30 degree model.

With respect to frame 306 of the 60 degree model, the left knee/lead knee and left hip/left knee are moving back in the direction of and parallel to section 306B, the right hip/trail hip will be moving back and slightly down at an angle and parallel to 306D. While this motion is happening the right knee/trail knee will be briefly moving slightly down in the direction of section 306D. When the right knee becomes parallel with joint 312D the right knee will rapidly change directions and then start moving in the direction of and parallel to section 306E at a slight downward angle. As this rapid direction change is taking place the weight in the right/trail foot is moving from the heel to the ball joint of the right/trail foot. While the weight is moving to the ball joint of the right/trail foot the user must allow the right/trail heel to come off the ground. This will put the majority of the weight of the right/trail side of the body in the ball joint of the right/trail foot. While the majority of the weight of the left/lead side of the body will be back in the left/lead heel.

Once at this position the right heel will be two to three inches off of the ground. When the right/trail knee reaches the vertical member 310, it has continued to move in a slight downward angle and parallel to section 306E to reach this point. From here the user must start the pivot of the ball joint of the right/trail foot, the ball joint, while starting this pivot move the right/trail ankle (outside part of the ankle) will move in the direction of and parallel to the support members 316A-316B. This pivot action will allow the right/trail knee to change directions and continue in the direction and parallel to section 306A at a slight upward angle. As the pivot completes and the right/trail foot is extended onto the big toe. The right knee/trail knee will continue to move in the direction and parallel to section 306A at a slight upward angle, and then finally come to rest just above joint 312A and parallel to section 306A. At this position, the left hip/lead hip will have moved back at an upward angle in the direction of section 306B and come to rest parallel to the middle of section 306C while the right hip will have come to rest parallel to and at a slight downward angle to the vertical support 310. Also when in this completed position the center of the pelvis will be facing the center of and parallel to joint 312A at a tilted angle. Thus, completing the downswing shift of the lower body in the 60 degree model.

While the lower body is working the correct angles inside of the 30 degree and 60 degree models using the guides, the shoulders will be working the surrounding guides as well. For the 30 degree model, the left side/lead side of the body or the left knee/lead knee and left hip/lead hip are moving back following the movements of the lower body and foot work mentioned above; the left shoulder will move up and back at a slight angle and parallel to section 106A, then move parallel to section 106B at a slight tilted angle upward and back, and then move slightly back at a tilted angle upward to section 106C and finally coming to rest at the joint 112C for the 30 degree model. As this is happening with the left shoulder/lead shoulder, the left elbow/lead elbow will move back in the direction of section 106B at a slight upward angle and parallel to section 106B, then back on a slight back and upward angle on section 106C and coming to rest past the joint 112C. When the left elbow/lead elbow has come to rest it will be parallel to section 106C but behind the joint 112C. As this motion is happening the left hand/lead hand will be moving back and parallel to section 106A extremely close to the body. As the left side/lead side of lower body and movements of the left shoulder/lead shoulder and left elbow/lead elbow are simultaneously following the guides the left hand will continue to move back at an upward angle and parallel to section 106B and then section 106C placing the left hand/lead hand parallel to, at a slight upward angle, to section 106C and several inches in front of the joint 112C.

The right shoulder/trail shoulder movement will be the exact opposite of that mentioned above. While the left side/lead side of the upper body is following the guides of sections 106A-106C, the right side/trail side of the upper body will be following sections 106D, 106E and 106F, in the downswing shift. To start, while the left shoulder is moving back at an upward angle in the direction of section 106A, the right shoulder/trail shoulder will be moving back at a slight downward angle and parallel to section 106D. As the left shoulder/lead shoulder is moving back at an upward angle and parallel to section 106B, the right shoulder/trail shoulder will be moving down at a slight tilted angle and parallel to section 106E. Then as the left shoulder/lead shoulder continues its back and upward move parallel to section 106C, the right shoulder/trail shoulder will move down and parallel at a slight angle to section 106F.

During these parallel movements of the shoulders, the right elbow/trail elbow will move parallel to the movements of the left elbow following the guides of the device. While the left elbow/lead elbow is moving back at an upward and slightly tilted angle and parallel to section 106B, the right elbow/trail elbow will be moving down at a slight tilted angle and parallel to section 106E. As the left elbow/lead elbow moves back on an upward angle slightly tilted to section 106C the right elbow/trail elbow will move on a slight downward tilted angle and parallel to section 106F.

For the right hand/trail hand, the movements will be the exact opposite of the left. As the left hand begins to pull the rope/band/string end back in the direction and parallel to section 106A at a tilted angle, the right hand/trail hand will move slightly down at a tilted angle on section 106D. As the left hand/lead hand moves upward and back at a tilted angle parallel to section 106B the right hand/trail hand will be moving at a slight downward and tilted angle parallel to section 106E. As the left hand/lead hand completes its movement upward and back at a tilted angle and parallel to section 106C, the right hand/trail hand will be moving at a tilted angle down and parallel to section 106F.

When the motion of the downswing shift has been completed by the upper/parts of the body, the entire right arm/trail arm will be extended parallel to and at a tilted angle to section 106D, thus, bringing the right hand/trail hand back close to the posture pole, while the left hand will be at its furthest point away from the posture pole in the 30 degree model.

By having completed these movements in the 30 degree model the user will now know how to use the body and all of its parts correctly, in the backswing and downswing shifts, and truly get a sense and feel of how these angular and geometric movements need to be performed in 3 Dimensional Space.

For the frame 306 of the 60 degree model illustrated in FIGS. 2-4, the shoulders will be working the surrounding guides as well. As the left side/lead side of the body or the left knee/lead knee and left hip/lead hip are moving back following the movements of the lower body and foot work mentioned above; the left shoulder will move up and back at a slight tilted angle and parallel to section 306A, then move parallel to section 306B at a slight tilted angle upward and back, and then move slightly back at a tilted angle upward and back at a slight tilted angle to section 306C and finally coming to rest at the center of section 306C for the 60 degree model. As this is happening with the left shoulder/lead shoulder, the left elbow/lead elbow will move back in the direction of joint 312B at a slight upward and back angle and parallel to joint 312A, then back on a slight back and upward angle on section 306B and coming to rest past the center of section 306C When the left elbow/lead elbow has come to rest it will be parallel to section 306B but behind the center of section 306C. As this motion is happening the left hand/lead hand will be moving back and parallel to section 306A extremely close to the body. As the left side/lead side of lower body and movements of the left shoulder/lead shoulder and left elbow/lead elbow are simultaneously following the guides the left hand will continue to move back at an upward angle and parallel to section 306A and then parallel to joint 312A briefly and then in the direction and parallel to section 306B in a backward and slightly upward angle placing the left hand/lead hand parallel to, at a slight upward angle, to section 306B and several inches in front of the center of section 306C when completed.

The right shoulder/trail shoulder movement will be the exact opposite of that mentioned above. While the left side/lead side of the upper body is following the guides of sections 306A-306C, the right side/trail side of the upper body will be following 306C, 306D and 306E, in the downswing shift. To start, while the left shoulder/lead shoulder is moving back at an upward angle in the direction of section 306A, the right shoulder/trail shoulder will be moving back at a slight downward angle and parallel to section 306D. As the left shoulder/lead shoulder is moving back at an upward angle and parallel to section 306B, the right shoulder/trail shoulder will be moving down at a slight tilted angle and parallel to section 306E. Then as the left shoulder/lead shoulder continues its back and upward move parallel to section 306C, the right shoulder/trail shoulder will move down and across parallel at a slight angle to section 306F.

During these parallel movements of the shoulders, the right elbow/trail elbow will move parallel to the movements of the left elbow/lead elbow, following the guides of the device. While the left elbow/lead elbow is moving back at an upward and slightly tilted angle and parallel to section 306A, the right elbow/trail elbow will be moving down at a slight tilted angle and parallel to section 306D. As the left elbow/lead elbow moves back on an upward angle slightly tilted to section 306B the right elbow/trail elbow will move on a slight downward tilted angle and parallel to section 306E.

For the right hand/trail hand, the movements will be the exact opposite of the left/lead hand. As the left/lead hand begins to pull the rope/band/string end back in the direction and parallel to section 306A at a tilted angle, the right hand/trail hand will move slightly down at a tilted angle on section 306D. As the left hand/lead hand moves upward and back at a tilted angle parallel to section 306B the right hand/trail hand will be moving at a slight downward and tilted angle parallel to section 306E. As the left hand/lead hand completes its movement upward and back at a tilted angle and parallel to section 306C, the right hand/trail hand will be moving at a tilted angle down and across, parallel to section 306E.

When the motion of the downswing shift has been completed by the upper/parts of the body, the entire right arm/trail arm will be extended parallel to and at a tilted angle to section 306E, thus, bringing the right hand/trail hand back close to the posture pole, while the left hand will be at its furthest point away from the posture pole in the 60 degree model.

By having completed these movements in the 60 degree model the user will now know how to use the body and all of its parts correctly, in the backswing and downswing shifts, and truly get a sense and feel of how these angular and geometric movements need to be performed/executed in 3 Dimensional Space.

Downswing Shift Sequence

It should be recognized that while all of the movements of the backswing and downswing shift are being performed/executed, it is important to note that all of these movements are being done inside of, parallel to, and above the guides of the training device. Never, will any part of the body ever be moving directly over the top of, or touching the guides of the device during the backswing and downswing shifts. The guides of the device are just simply showing, in extreme detail, the path of the necessary movements and angle changes that must take place and when; when performing/executing the backswing and downswing shifts. Thus, allowing "Procedural Memory" to take place as one learns the complex motions necessary to perform the backswing and downswing shifts in a very simple manner.

Movements of the Club—BackSwing 30 Degree Model

To begin the movements of the golf club in the backswing of the 30 degree model (see for example, FIGS. 1-2), the user needs to remove the posture pole entirely from the device. Then, starting from a completed posture position the user will put the golf club in their hands using one of the described/established grips mentioned above.

Although the hands are the only part of the body connected to the golf club, they are not solely responsible for getting the golf club to the top of the backswing. We have learned above that it is the shifting motion of the body that will govern this movement, however, the hands and arms and the way they work are independent movements inside of the training device. The shifting motions in the backswing and downswing are teaching the user how the body has to move in the training device and now we will learn how to add the additional independent moves of the arms and hands to move the golf club correctly in the backswing.

To make the first move in the backswing, commonly known as the "Takeaway", the user will be holding the club in both hands and will start from a completed posture position. From there, the user will want to start the first part of the backswing shift with the entire body, learned above. As the backswing shift begins, the user will now allow the arms and hands and grip of the golf club/golf club, to move in the direction, at an upward angle and parallel to section 106F of frames 106. While this motion is happening; simultaneously the right shoulder will be moving back at an upward angle, in the direction and parallel above to section 106E of frames 106, while the left shoulder will be moving down and at a slight downward angle in the direction and parallel to section 106B. While making this movement with the arms/hands/grip of the club/golf club, the user will want to keep the clubface square to section 106F until the butt of the club is in a parallel and above position to joint 112E. When the butt end of the golf club gets parallel to the joint 112E the entire shaft of the golf club will be parallel to and slightly in front of the joint 112E and ¾'s upward at an angle on section 106F. The result of this completed position, in the training device, will place the left/lead hand approximately, "12 inches" away/inside above and parallel to section 106F at a slight upward and in angle.

No extra attempt or effort can be made to move the hands/arms/grip of the golf club/golf club across the body, in this direction. What is really happening is that the shifting movement of the body is what is making this, "Takeaway" move, and all the user needs to allow to happen; is that the arms, then hands, then the golf club grip/golf club are simply going to follow the shifting motion of the body, in a slight upward angle and parallel to section 106F on the correct path. There can be no physical lateral movement or turning sensations that occur while making this movement. It must be governed by the backswing shift.

Once the hands/grip end/butt of the golf club get parallel to the joint 112E, the right/trail elbow will start to move back and it will start to fold/bend slightly, at an upward angle and parallel to section 106E. This movement of the right/trail elbow will move/pull the hands in the correct upward and parallel direction to section 106E. As the right/trail elbow is starting to draw back onto section 106E the left/lead elbow will start to move across the center of the body, in a parallel and above direction to section 106F. As the hands follow the right/trail elbow to get to section 106E they will experience angle changes in the wrist joints of both hands along the way, commonly known as the, "Wrist Set", in the modern golf swing. In order to understand how the wrist set needs to happen, all the user needs to do is allow the hands to follow the joint 112E starting at the bottom of this joint, piece connected to section 106F and then following it to where it connects to section 106E. As the hands are following the joint 112E, from beginning to end, the right and left forearms will rotate clockwise to get the hands and golf club parallel and above section 106E. When the hands are starting to make the angle change/wrist set, beginning the following of the joint 112E, the shaft will be parallel to and above section 106F as the hands move in the direction of the first part of the joint. As the hands continue to move towards the end of the joint 112E, the second part of the joint connected to section 106E, the shaft of the golf club will now get parallel and above the section 106E guide. Once this full movement has taken place, in motion, the hands will now be parallel to, at an upward angle and slightly in front of and above the converging point of joint 112D, and the left/lead hand will be approximately, "6 inches" to the inside of section 106E. From this position, commonly thought of as (Position Three) in the modern swing, the right/trail elbow will now continue to move back in the direction, at an upward angle and parallel to section 106D. As the right/trail elbow continues to move in the direction of section 106D the hands will continue to follow the guide of the joint 112D.

As the hands start to move on the beginning part of this joint and then continue to the ending part of this joint, where it connects to the section 106D guide, the shaft of the golf club will now be parallel to and above, at a slight upward angle, to section 106D. When these movements are completed the left/lead elbow and left/lead shoulder will now be placed perfectly parallel to section 106F. Thus, completing the backswing movements of the arms, hands, and golf club to the top of the backswing. While these movements are happening with the arms, hands, and golf club it is critical to understand that they have to happen in unison with the backswing shift in order to be executed/performed correctly. When done correctly, the top of the backswing will have been reached completely, to the true endpoint of the backswing. This completed movement or position is what is commonly known as "Position Four", in the modern golf swing.

Movements of the Club—Downswing 30 Degree Model

Starting from the completion of the backswing, the user will start the downswing shift with the body as previously mentioned. As the downswing shift begins the arms, hands and golf club grip/golf club will start to follow the guides in the opposite direction of how they arrived to the top of the backswing.

As the downswing shift begins the right/trail shoulder will move the hands/grip of the golf club/butt of the golf club, back at a slight downward angle in the direction and parallel to and above section 106D, because of this movement, the right/trail elbow will follow this path. As a result of this movement the left/lead shoulder will starting working up at a slight angle in the direction above and parallel to section 106A and the left/lead elbow will be working in the direction, at a slight downward angle, above and parallel to section 106F. It is this move that is the beginning of what is commonly called the "Release of The Golf Club" in the downswing for modern golf swing.

As the downswing shift continues to happen, with the body; the right/trail shoulder will move the hands/grip of the golf club/butt of the golf club, parallel and at a slight downward angle and above, in the direction of the joint 112D guide, the part of the joint connected to section 106D, simultaneously, the left/lead shoulder will be starting it's move parallel and above in the direction of joint 112A the part of the joint connected to section 106A, as this is happening in unison, the left/lead elbow will be continuing to move in a slight downward angle above and parallel to section 106F and slightly behind the vertical member 110.

From here the hands/golf club grip/butt of the golf club will continue to move at a slight downward angle above and in the direction and parallel to, the bottom part of the joint 112D, the part of the joint connected to section 106E. This is where the "Release", of the golf club truly begins. The right/trail shoulder and elbow will be following the same path. As this is happening the left/lead shoulder will be moving upward at a slight angle in the direction, parallel to and above the joint 112A the part connected to section 106B. Simultaneously, the left/lead elbow will start to move at a slight upward angle, parallel to, and above, in the direction of section 106A. From here, the hands/grip of the club/butt of the club will now begin to move in the direction, parallel to and above section 106E, thus, causing the right/trail shoulder and right/trail elbow to follow on the same path of section 106E slightly behind the hands. Simultaneously, the left/lead shoulder will be working up and back at a slight tilted angle parallel to and above section 106B, as the left/lead elbow will be continuing to move up at an angle parallel to and above section 106A. This position is also commonly referred to in the modern golf swing as "Position Five".

As the downswing shift continues to drive the movements of the body, explained above, the hands/golf club grip/butt of the golf club, will start moving in the direction, parallel to and above, at a slight downward angle to the joint 112E, part connected to section 106F. At this point, the right/trail elbow and right/trail shoulder will continue to follow the hands but they will be even more behind the hands and moving parallel to and above section 106E. As the hands are making this movement parallel to the joint 112E, the left/lead shoulder we'll be moving back at an upward angle above and parallel to the joint 112B. As this movement continues to happen the left/lead elbow will now be parallel to and above the section 106A guide almost to, but in front of the joint 112A.

As lower body continues the downswing shift, the hands will start to move rapidly through the hitting area, causing them to move in a direction parallel to and above the vertical support 110 on the inside of the training device guides. This lateral movement across begins when the hands have completed their parallel and above movement coming out of the joint 112E and does not begin until the hands have moved half way down, at an angle parallel to and above the section 106F guide.

When the hands have reached the halfway point of the section 106F guide, they will start to move the butt of the golf club in the direction towards, laterally, section 106A but remain parallel to, and above and to the inside of the member 116A-116B and inside of the section 106F and section 106A guides. While this release of the hands is taking place the left/lead shoulder will be moving back, at a slight upward angle and parallel to section 106C and the left/lead elbow, will be moving at a slight upward angle parallel to and above section 106A. As the body continues to follow the downswing shifting motion the hands/golf club grip/butt of the golf club, will start moving in a slight upward direction and parallel to section 106A. The body's shifting motion is starting to pull everything up at a slight upward angle from here on out.

As the downswing shift continues to drive the body, the pivot of the right/trail ball joint of the foot, learned above in the downswing shift, will enable the hips to start to clear. This will allow the energy and weight of the body to bring the golf club face into the "Impact or Hitting area", commonly known in the modern golf swing as "Impact/Position Six", the point where the golf club face will actually make contact with the golf ball.

When combined with the motions of the downswing shift and the pivot of the right/trail foot, the club face will now come into the ball by continuing to move the hands/golf club grip/butt of the golf club, in the direction and parallel to and above section 106A. Because of the release of the club happening so fast, the golf ball just gets in the way of the golf club face coming through the "Hitting Area", and we are not trying to force an "Impact Position", as commonly taught in the modern golf swing. We are just continuing to follow the guides in the training device and "Impact" will take care of itself.

As the hands are continuing to move in the direction of section 106A at a slight upward and parallel angle this point, the right/trail hand will start to take over when striking the golf ball. The split second after the golf ball has been struck the hands will continue to move upward at a slight angle parallel and above section 106A, then parallel and above, into and out of, the joint 112A, then at an upward and a slight angle parallel to and above section 106B, then parallel and above, in and out of the joint 112B, commonly known as "Position Seven" in the modern golf swing, and then back and around in the direction of section 106C parallel to and above. Thus, completing the movements of the hands and golf club through the entire movements of the downswing motion.

As these movements are taking place with the hands/golf club grip/golf club. The following movements will be happening simultaneously and unison with the movements of the hands. The left/lead elbow will have moved up and back parallel to and above the same guides as the hands. While this is all happening the left/lead shoulder will have continued to move up and back at an angle parallel to and above section 106C but will also continue to move even further back and at a downward angle and parallel to section 106D when the full motion of the downswing has been completed and come to rest. The finished position of the golf swing is commonly called, "Position Eight" in the modern golf swing.

In addition, it should be understood that after coming through the hitting/impact area the right/lead elbow will be fully extended, then as the hands continue to move, as described previously, they will then pull the right/trail elbow and right/trail shoulder through the entire sequence the hands just followed to arrive at a completed downswing motion.

Also, right after the point of the right/trail elbows full extension, as the hands start following the guides on the left side as described above, the right/trail hand will start to work over and around the left/lead hand and force the forearms to roll counterclockwise at an upward angle above and parallel to section 106B, and then to section 106C, as the hands continue to follow their path following the guides.

As demonstrated previously every move in the training device is teaching the user how the body and its parts have to be moving parallel to and above the guides at all times. When one part of the body is following a certain part of the guides in the training device, the other side of the body will be following the opposite parallel guides, on the other side of the body and the other side of the training device.

It should further be noted that the description provided previously is in the perspective of a right handed player, everything would just be the opposite for a left handed player as the training device is symmetrical and can be used by either a right handed or left handed player.

Movements of the Club—Backswing 60 Degree Model

Since the movements of the body and it's parts have been explained in great detail above and understanding the body will always be moving parallel and above at slight upward and downward angles to the device, the movement of the hands/golf club grip/golf club when explaining their movements in the 60 degree model in general will now be described in reference to training device 300.

Starting from a completed posture position, mentioned above, the user will want to start moving their hands back, parallel to and above, in the direction of section 306F, right side for a right handed player. Then when the hands are parallel to and above the joint 312E, they will then start to move slightly upward on a 45 degree angle parallel and above and to the inside of the training device.

The next movement the hands will make is to follow the section 306E guide at a slight upward and parallel movement, until the hands become positioned parallel to and above the joint 312D. At this point, the hands will continue to move slightly upward in a 90 degree angle parallel to and above the joint 312D, then continue to move in the direction, up at an angle and back parallel to and above section 306D until the hands reach the joint 312C. From here the hands will move back at a 45 degree angle until they are parallel and above the section 306C extremely close to the joint 312C, just a little past or even with, depending on flexibility. Thus, completing the movements of the hands in the backswing motion.

To start the downswing movements the hands are just going to move in the opposite direction, above and parallel to, each guide of the training device until the downswing is completed. So starting from the top of the downswing the hands will start to move back at a slight downward angle parallel and above the section 306C or the joint 312C depending on flexibility. As the hands make the 45 degree angle change moving parallel and above the joint 312C, they will continue to move in the direction, parallel and above section 306D at a downward angle, until the reach the joint 312D. When continuing to move the hands in the same direction, parallel and above as the joint 312D, the hands will then continue to move in the same direction, parallel and above section 306E, until they reach the joint 312E. As the hands continue to move they will change directions at 45 degree until they are now moving parallel and above the (Bottom Line).

As the hands keep moving across the section 306F they will come to the joint 312E. At this point the arms will be fully extended and parallel and above this 45 degree guide. The next move is for the hands to move parallel and above in the direction of the joint 312E, until they start moving in the direction, parallel and above section 306A. As the hands continue to move in the direction of 306A, at an upward angle, they will come to the converging point of the joint 312A. At this point, the hands will changes directions at 45 degree forcing the hands to start moving back at an upward angle back and parallel and above section 306B. As the hands continue to move from this point they will continue at an upward angle until the joint 312B. Once at this converging point the hands will back at an upward angle until the hands are moving back in the direction and parallel to and above the section 306C. Once the hands have moved to the section 306C from the lead side of the training device, the downswing movements will be completed. How far the hands continue to move in the direction of the section 306C will depend on user flexibility. Also, while making these movements with the hands the body and arms will know what to do based off of the learning process of the backswing and downswing shifts.

It truly becomes kind of like a paint-by-numbers approach to learning, but instead of using numbers the user uses the guides, in the various frame configurations, to understand and see where certain things have to happen, at certain points in time/space, at certain times during the swinging motion. The unlimited potential the training device gives the end user is unmatched by any device out in the world today.

It should further be understood that while the training device is explained in great detail herein in the context of learning the correct movements necessary to perform a golf swing, the training device may be used for training in sports other than golf (e.g., baseball, softball, basketball, tennis, hockey, etc.) and all kinds of different human movements.

Moreover, although in one embodiment, the device is described as having a posture pole that sits at an angle of 60 degree, and off of that posture pole, the guides sit at 30 degree and 60 degree angled down from it. The angles may be changed to 15 degree, 45 degree, 75 degree, etc., instead of 30 degree or 60 degree used in the two models, to learn other angular and athletic movements. For example, at these other angles, the device may be used to teach a user how to move a hockey stick correctly, or how to shoot free throws in basketball, or how to teach a user the mechanics to properly throw a baseball (the current angular position of the 30 degree model covers that).

In addition, the position of the posture pole may be changed to 90 degree and the vertical support 310 to 90 degree, changing the height of each, to a certain dimension/or equal to, you would then be able to suspend the guides in mid air parallel to the ground to be able to teach the mechanics of a level baseball or softball swing (even though the training device in its current degrees will teach the correct movements necessary for a baseball or softball swing, just not a level one). Or possibly the mechanics of how to throw a proper punch in boxing or martial arts (could also be explained or taught changing the angles as mentioned above).

It should be understood, however, that the sizes, shapes and dimensions of the pieces of the training device disclosed herein are only examples, and other sizes, shapes and dimensions are contemplated. For example, the guides may be larger or may be smaller depending on other the requirements of other sports.

Still further, the device may have a fixed height and width, or may have an adjustable height and width. The device may further be mounted in a fixed position (such as to a support member), or may be portable.

In addition, in some embodiments, when all the pieces of the device are assembled together, it creates the outer perimeter of a polygon shape, or cube (see FIGS. 1-4). For example, the 30 degree model (as shown in FIGS. 1-2 and FIGS. 7A-7C) may be considered a polygon, or a cube, pointed upward, and the 60 degree model (as shown in FIGS. 3-4 and FIGS. 6A-6C) may be considered a polygon, or a cube, sitting at a different angle (flat if you will).

In addition, it should be understood that while the various stance and swing sequences described herein are described in reference to the frames 100 and 300 of FIGS. 1-4, the same stance, swing, sequences, etc. apply to devices 600 and 700, and associated frames 606 and 706, of FIGS. 6A-6C and FIGS. 7A-7C, respectively, to guide and/or train the swing in a similar manner.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. For several of the ideas presented herein, one or more of the parts may be optional. The invention should therefore not be limited by the above described embodiment, method, and examples, but by all embodiments and methods within the scope and spirit of the invention.

What is claimed is:

1. A swing training apparatus comprising:

a frame having a plurality of frame sections that are joined together by adjustable joints to form an open space within the frame that is dimensioned to surround a user during training, wherein the adjustable joints are operable to transition the frame between different polygon shapes;

a first support member coupled to a first frame section that defines a first side of the frame and suspending the first side of the frame above ground; and a second support member coupled to a second frame section that defines a second side of the frame that is opposite of the first side of the frame and suspending the opposite side of the frame above ground, and wherein the first support member and the second support member together are operable to adjust an angle of the frame relative to ground.

2. The swing training apparatus of claim 1 wherein the plurality of frame sections comprise from six sections to eight sections that are connected together by the adjustable joints.

3. The swing training apparatus of claim 1 wherein the plurality of frame sections comprise at least a first section and a second section that form an angle with respect to one another, and wherein the first section, the second section and the angle are selected to guide a swing of a user.

4. The swing training apparatus of claim 1 wherein the angle of the frame relative to ground is adjustable within a range of from 30 degrees to 60 degrees.

5. The swing training apparatus of claim 1 wherein the first support member and the second support member comprise at least one adjustable joint operable to adjust the angle of the frame relative to ground in 5 degree increments.

6. The swing training apparatus of claim 1 wherein the plurality of frame sections form a hexagon shape and the angle of the frame relative to ground is from 30 degrees to 60 degrees.

7. The swing training apparatus of claim 1 wherein the plurality of frame sections form an octagon shaped frame and the angle of the frame relative to ground is 60 degrees or less.

8. The swing training apparatus of claim 1 further comprising a posture pole extending above the frame at an angle suitable for guiding a posture of a user positioned within the open space.

9. The swing training apparatus of claim 1 wherein the first support member or the second support member comprises a vertical member and a horizontal member connected by a collapsing joint that allows for the vertical member and the horizontal member to fold into a storage configuration.

10. A swing training apparatus comprising:

a frame and a support member to suspend the frame at a predetermined angle relative to ground, the frame having a plurality of straight frame sections that are joined together by adjustable joints, the adjustable joints allow the frame to transition between different polygon shapes dimensioned to surround a user in a training configuration, and to collapse with respect to one another in a storage configuration.

11. The swing training apparatus of claim 10 wherein the plurality of straight frame sections form a polygon shaped open space that does not contain an interior frame in the training configuration.

12. The swing training apparatus of claim 10 wherein the predetermined angle of the frame is adjustable relative to the support member in 5 degree increments within a range of from 30 degrees to 60 degrees relative to ground.

13. The swing training apparatus of claim 10, wherein the support member is coupled to a front-most straight frame section or a back-most straight frame section.

14. The swing training apparatus of claim 10, wherein the frame is symmetrical about a center axis running from a front side to a back side of the frame, and the support member is a first support member connected to a section positioned along one side of the center axis and a second support member is connected to a section positioned along another side of the center axis.

15. The swing training apparatus of claim 10, wherein the support member is connected to the frame at rotating connection joints, wherein the rotating connection joints allow for adjustment of the predetermined angle of the frame.

16. The swing training apparatus of claim 10, wherein the support member is a first support member and the first support member is connected to a second support member by a laterally extending bar, the laterally extending bar having an adjustable length.

17. The swing training apparatus of claim 10, further comprising a posture pole that extends above the frame at a predetermined angle suitable for aligning a posture of a user, or a putting attachment, wherein the putting attachment is removably attached to the support member and provides a guide for a putting motion.

* * * * *